US006791814B2

(12) United States Patent
Adachi et al.

(10) Patent No.: US 6,791,814 B2
(45) Date of Patent: Sep. 14, 2004

(54) ION GENERATING APPARATUS

(75) Inventors: Yoshiichi Adachi, Nagoya (JP); Yuji Kato, Nagoya (JP)

(73) Assignee: Nihon Pachinko Parts Co., Ltd., Nagoya (JP)

( * ) Notice: Subject to any disclaimer, the term of this patent is extended or adjusted under 35 U.S.C. 154(b) by 204 days.

(21) Appl. No.: 10/149,218

(22) PCT Filed: Nov. 26, 2001

(86) PCT No.: PCT/JP01/10283

§ 371 (c)(1),
(2), (4) Date: Jun. 10, 2002

(87) PCT Pub. No.: WO03/047058

PCT Pub. Date: Jun. 5, 2003

(65) Prior Publication Data

US 2003/0098650 A1 May 29, 2003

(51) Int. Cl.[7] ..... H01T 23/00
(52) U.S. Cl. ..... 361/231; 361/232
(58) Field of Search ..... 361/231, 232

(56) References Cited

U.S. PATENT DOCUMENTS 4,635,161 A * 1/1987 Le Vantine ..... 361/213
4,652,694 A * 3/1987 Goldman et al. ..... 174/3
5,121,286 A * 6/1992 Collins ..... 361/231
5,249,094 A * 9/1993 Hayakawa et al. ..... 361/229
5,447,763 A * 9/1995 Gehlke ..... 428/34.1
5,488,222 A * 1/1996 Gault et al. ..... 250/324
6,654,225 B2 * 11/2003 Takayanagi ..... 361/231

FOREIGN PATENT DOCUMENTS

| | | |
|---|---|---|
| JP | 11-111427 | 4/1999 |
| JP | 3076187 | 12/2000 |
| JP | 3242637 | 10/2001 |
| JP | 2002-15834 | 1/2002 |

* cited by examiner

*Primary Examiner*—Hung V. Ngo
(74) *Attorney, Agent, or Firm*—Snider & Associates; Ronald R. Snider

(57) ABSTRACT

An ion generating apparatus 1 has an electric cleaning mechanism 79 for burning out attachment adhered on an ion generating electrode 7 by electric heating. Adhesion of dirt and the like onto the end portion of the electrode where an electron generation field concentrates will considerably ruin the ion generation efficiency. So that burning out of attachment adhered onto the end portion 7*a* of the ion generating electrode 7 using the electric cleaning mechanism 79 is extremely effective in terms of avoiding such nonconformity. Object of the cleaning will be attained to a sufficient degree if only the dirt adhered onto the sharpened end portion of the electrode 7, which is responsible for the ion generation, is selectively removed, which is also advantageous in simplifying the apparatus since there is no need to excessively raise the electric heating capacity of the electric cleaning mechanism 79.

30 Claims, 21 Drawing Sheets

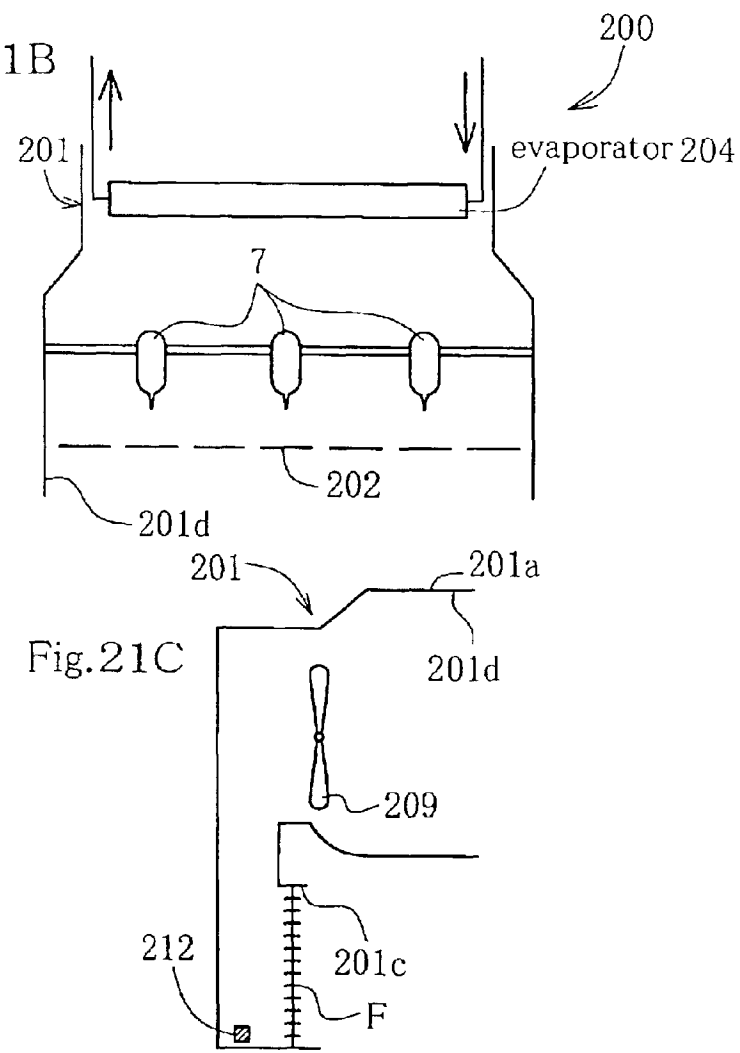
Fig. 21B
Fig. 21C
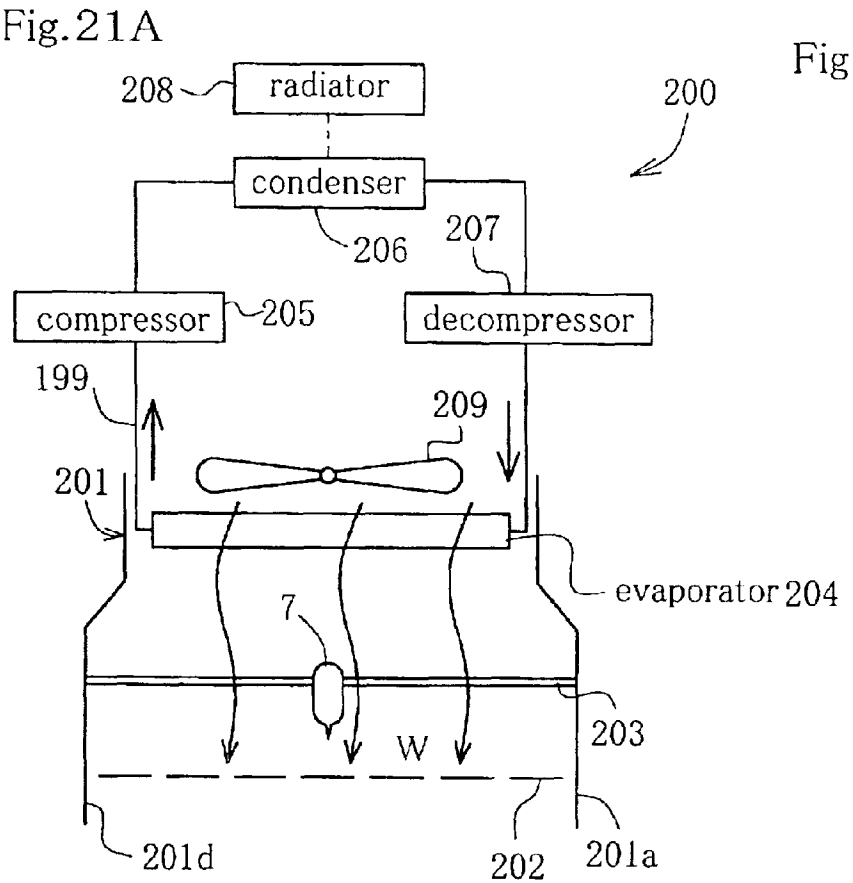
Fig. 21A

ION GENERATING APPARATUS

FIELD OF THE INVENTION

The present invention relates to an ion generating apparatus.

DESCRIPTION OF THE BACKGROUND ART

Ion generating apparatuses have previously been used for cleaning, disinfection and deodorization of the air in rooms or automobiles. Most of such apparatuses have an AC power source portion, a step-up transformer and a needle electrode, all of which being housed in an enclosure, in which a high AC voltage raised by the transformer is applied to the needle electrode to thereby activate corona discharge, and ions generated by the discharge are emitted from an ion emitting hole opened in the enclosure. Both negative ions and positive ions are possibly generated by the ion generating apparatus, where negative ions are generally believed to be more excellent in cleaning, deodorizing and disinfectant effects.

A problem will however arise in that airborne dust, oil or other dirty matters may adhere onto the ion generating electrode so as to finally cover the discharge plane thereof during a long-term use of such ion generating apparatus. Once such situation occurs, the discharge for generating ions will badly be interfered, which may result in lowered ion generation efficiency, and more worse discontinuance of the ion generation.

Japanese Laid-Open Patent Publication No. 11-111427 discloses an apparatus having a needle cathode for generating ions and a grounded anode opposed thereto to thereby generate negative ions, in which the distance between both ends of the cathode and anode positioned in parallel is properly adjusted to thereby successfully prevent dirt adhesion, as well as to suppress ozone smell and to raise the negative ion generation efficiency. In this prior art, a problem however resides in that the dirt adhesion onto the needle cathode per se cannot be prevented at all.

It is therefore an object of the present invention to provide an ion generating apparatus capable of removing dirt adhered on the ion generating electrode in a simple and effective manner, and furthermore capable of efficiently preventing the ion generation efficiency from being degraded due to dirt adhesion or suppressing of such degradation.

DISCLOSURE OF THE INVENTION

To solve the foregoing problems, an ion generating apparatus of the present invention is characterized in that comprising an ion generating electrode for generating negative ions while being applied with a negative high voltage; a high-voltage generating portion for ion generation for applying high voltage for generating ions to the ion generating electrode; and an electric cleaning mechanism for burning out attachment adhered on the ion generating electrode by electric heating.

According to the constitution of the present invention, the electric cleaning mechanism is provided to burn out dirt adhered on the ion generating electrode through electric heating, so that the dirt can be removed in a thorough and simple manner, and thus the apparatus can successfully prevent the ion generation efficiency from being degraded due to dirt adhesion. In particular, in case of the ion generating electrode having a sharp end, dirt adhesion to such portion where the ion generating field concentrates will considerably ruin the ion generating efficiency. Burning out of the attachment on the end portion of the ion generating electrode using the electric cleaning mechanism will be extremely beneficial to avoid such nonconformity. In this case, an object of the cleaning will be attained to a sufficient degree if only the dirt adhered onto the sharp end portion of the electrode, which is responsible for the ion generation, is selectively removed, which is also advantageous in simplifying the apparatus since there is no need to excessively raise the electric heating capacity of the electric cleaning mechanism.

The ion generating electrode may also be composed so as to generate ions by corona discharge using an counter electrode. The counter electrode in this case may also function as a dust collecting electrode. On the other hand, such composition may not always ensure a desirable ion generating efficiency since generated negative ions may be attracted by the counter electrode and may adhere thereon or decompose. So that, it is advantageous to compose the ion generating electrode as a lone electrode without being accompanied by any counter electrode for discharge, in terms of raising the ion generating efficiency if the dust collecting electrode is not specifically needed. While a mode of electric discharge for generating ions in this case may be understood as analogous to corona discharge, it is different in a precise meaning from generally-understood corona discharge since no apparent counter electrode is involved. However in many cases, a discharge mode similar to corona discharge may be established since some conductive members outside the apparatus can eventually act as the counter electrode even though such members were not intended for functions of an electrode.

The electric cleaning mechanism may be such that comprising a spark-discharge counter electrode for spark discharge located as being opposed to the ion generating electrode, and a spark-discharge, high-voltage generating portion for applying high voltage for the spark discharge between the ion generating electrode and the spark-discharge counter electrode, so that the attachment adhered on the ion generating electrode can be burnt out by spark-by-discharge generated between such ion generating electrode and such spark-discharge counter electrode upon being applied with a high voltage. Using spark discharge, heat generated by spark can efficiently be concentrated on the surface of the electrode to thereby remove the adhered dirt in a more complete manner. The ion generating electrode having a sharp end is advantageous in activating spark discharge for the cleaning without failure if such sharp end, where the electric field tends to concentrate, is opposed with the spark-discharge counter electrode.

An opposition distance (referred to as "gap distance", hereinafter) between the ion generating electrode and the spark-discharge counter electrode during spark discharge depends on the magnitude of applied voltage, where a preferable range thereof for ensuring desirable spark generation is 2 mm or less, and more preferably 1 mm or less for applied voltage of up to 4,000 V or around. Spark for the discharge may be generated in a continuous manner, or intermittent manner so as to avoid excessive temperature rise of the electrode.

It is allowable for such case to provide a moving mechanism for the spark-discharge counter electrode which relatively moves it closer to or more distant from the ion generating electrode at least between a furthest position allowing ion generation from the ion generate electrode and a closest position allowing generation of the spark-by-discharge between the spark-discharge counter electrode and ion generating electrode. Keeping the spark-discharge counter electrode away from the ion generating electrode during the ion generation will successfully prevent undesirable spark discharge from occurring during a period essentially responsible for the ion generation. It is, however, also allowable to fix the gap distance between the spark-discharge counter electrode and the ion generating electrode, and to activate spark discharge by applying a higher voltage than that for the ion generation.

The electric cleaning mechanism may be such that including a resistance heating mechanism for burning out attachment adhered on the ion generating electrode by heating such ion generating electrode through resistance heating. By effecting resistance heating in at least an area to be cleaned of the ion generating electrode, the attachment such as dirt can efficiently be removed. The resistance heating mechanism may be such that comprising a current-fed member movable between a contact position allowing it to contact with the ion generating electrode and a distant position apart from such ion generating electrode, and a power source portion for current-fed heating for feeding electric current via such current-fed member to the ion generating electrode for resistance heating while being contacted with such ion generating electrode. In particular, in the case of the ion generating electrode having a sharp end, temperature of such end portion of the electrode, which is critical for the ion generation, can selectively be elevated by feeding current via the current-fed member contacted to such end portion having a gradually reducing sectional area, which eventually ensures the attachment removal (cleaning) for the end portion of the electrode at a small electric power without failure.

The ion generating apparatus of the present invention may have an automatic cleaning mechanism control portion capable of automatically activating, according to a predetermined timing, the electric cleaning mechanism so as to clean the ion generating electrode. This allows automatic cleaning of the ion generating electrode, and facilitates keeping of such electrode always in a clean condition.

In the ion generating apparatus of the present invention, the high-voltage generating portion may be composed of a transformer. While the transformer may be of wire-wound type, it is also preferable to use a piezoelectric transformer having on a piezoelectric ceramic device board an input terminal and an output terminal, whereby primary AC input voltage applied to the input terminal is raised by being mediated by mechanical vibration of such piezoelectric ceramic device board to the secondary AC output voltage to be output through the output terminal towards the ion generating electrode. The piezoelectric transformer, having no core and coiled portion, is compact and lightweight, which is advantageous in downsizing and weight reduction of the ion generating apparatus. In the case the ion generating apparatus is used as being incorporated into an air conditioner for cooling and heating as described later, such piezoelectric transformer can readily be assembled using a free space within the air conditioner since a circuit board of the ion generating mechanism can markedly be downsized.

Ozone generation due to silent discharge in the air will considerably increase in particular when the applied voltage has a high frequency with alternating polarity. In the case a wire-wound transformer is used, leakage magnetic field which alternatively changes depending on AC frequency tends to reach a higher level since the secondary side of the transformer has a larger number of turn in order to generate high voltage. If the ion generating electrode is placed within such leakage magnetic field, the ozone generation may be enhanced due to high-frequency current induced within the ion generating electrode. Using the piezoelectric transformer having no wound wire by nature may be successful in reducing a leakage magnetic field level sensible by the ion generating electrode, and thus may be more advantageous in suppressing the ozone generation.

The ion generating apparatus of the present invention may have a polarity conversion means for converting the secondary AC output voltage so as to ensure negative predominance of the polarity of voltage applied to the ion generating electrode. The polarity conversion means may be composed of a rectifying means which rectifies secondary AC output from the piezoelectric transformer so as to typically allow charge transfer having a directionality of negatively charging up the ion generating electrode but inhibit charge transfer having an opposite directionality. Further providing a condensing means for condensing negative charge, derived from the secondary AC output of the piezoelectric transformer, to be applied to the ion generating electrode will ensure stable generation of negative ions since the ion generating electrode can constantly be supplied with a negative voltage above a certain level. Combining such condensing means with the foregoing rectifying means will ensure more advanced level of stability in negative high voltage to be applied to the ion generating electrode, which can considerably downsize the apparatus as typically compared with the case of using a specialized high-voltage DC power source.

BRIEF DESCRIPTION OF THE DRAWINGS

FIG. 21A is a schematic drawing of the ion generating unit as incorporated into an air conditioning unit;

FIG. 21B is a schematic drawing as continued from FIG. 21A;

FIG. 21C is a schematic drawing as continued from FIG. 21B; and

BEST EMBODIMENTS FOR CARRYING OUT THE INVENTION

Best embodiments for carrying out the present invention will be explained referring to several examples shown in the attached drawings.

Figure 1:
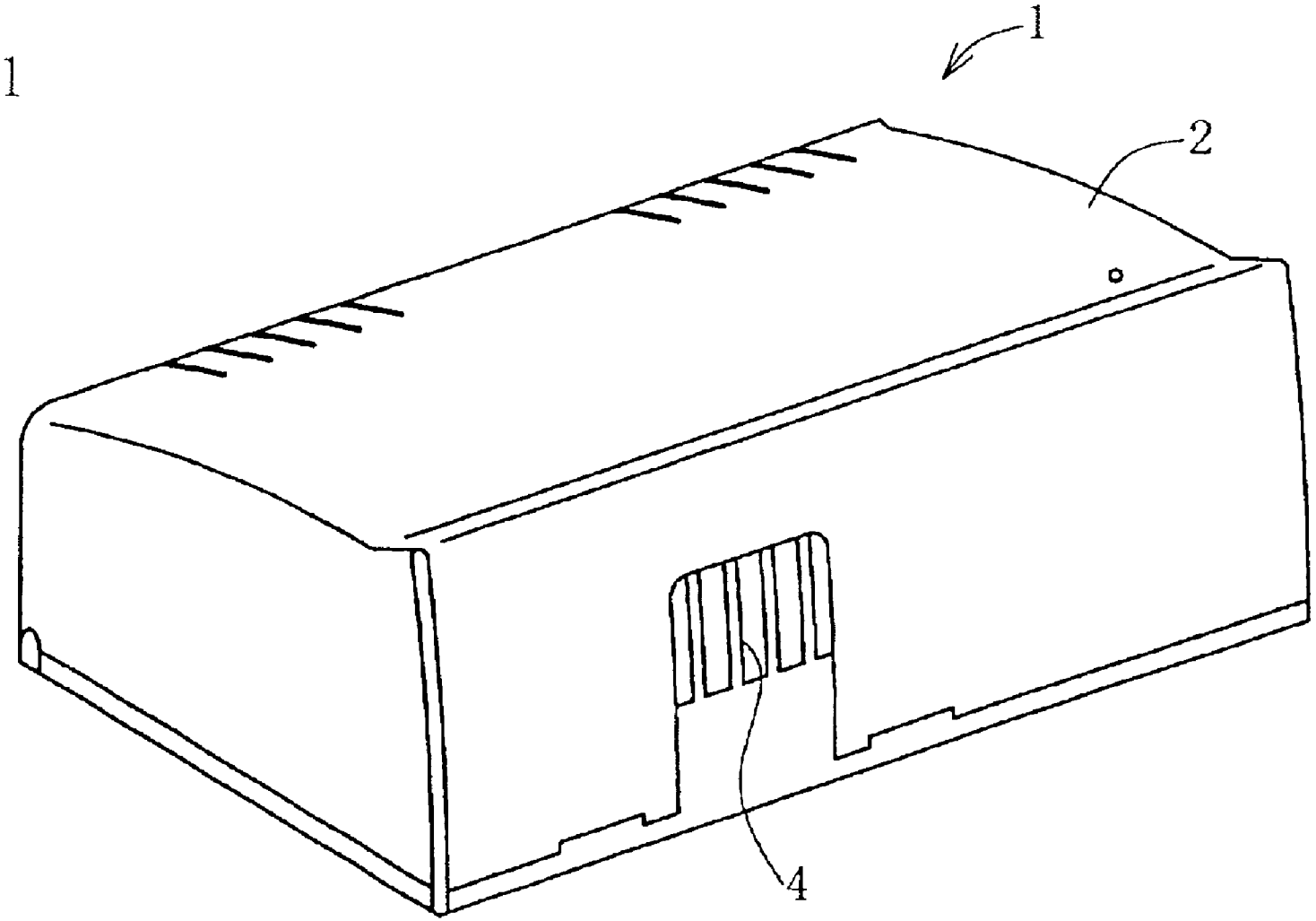
FIG. 1 is a perspective view of an outer appearance of an exemplary ion generating apparatus of the present invention.

FIG. 1 shows an outer appearance of an ion generating apparatus according to one example of the present invention, where the apparatus has a hollow case 2 as an enclosure composed of a plastic molding. While the shape of the case 2 is not specifically limited, the example shown herein has an axially-elongated and somewhat flattened shape, and has on one lateral plane thereof an ion emitting hole 4. The lateral plane of the case 2 is provided with a power switch 3.

Figure 2:
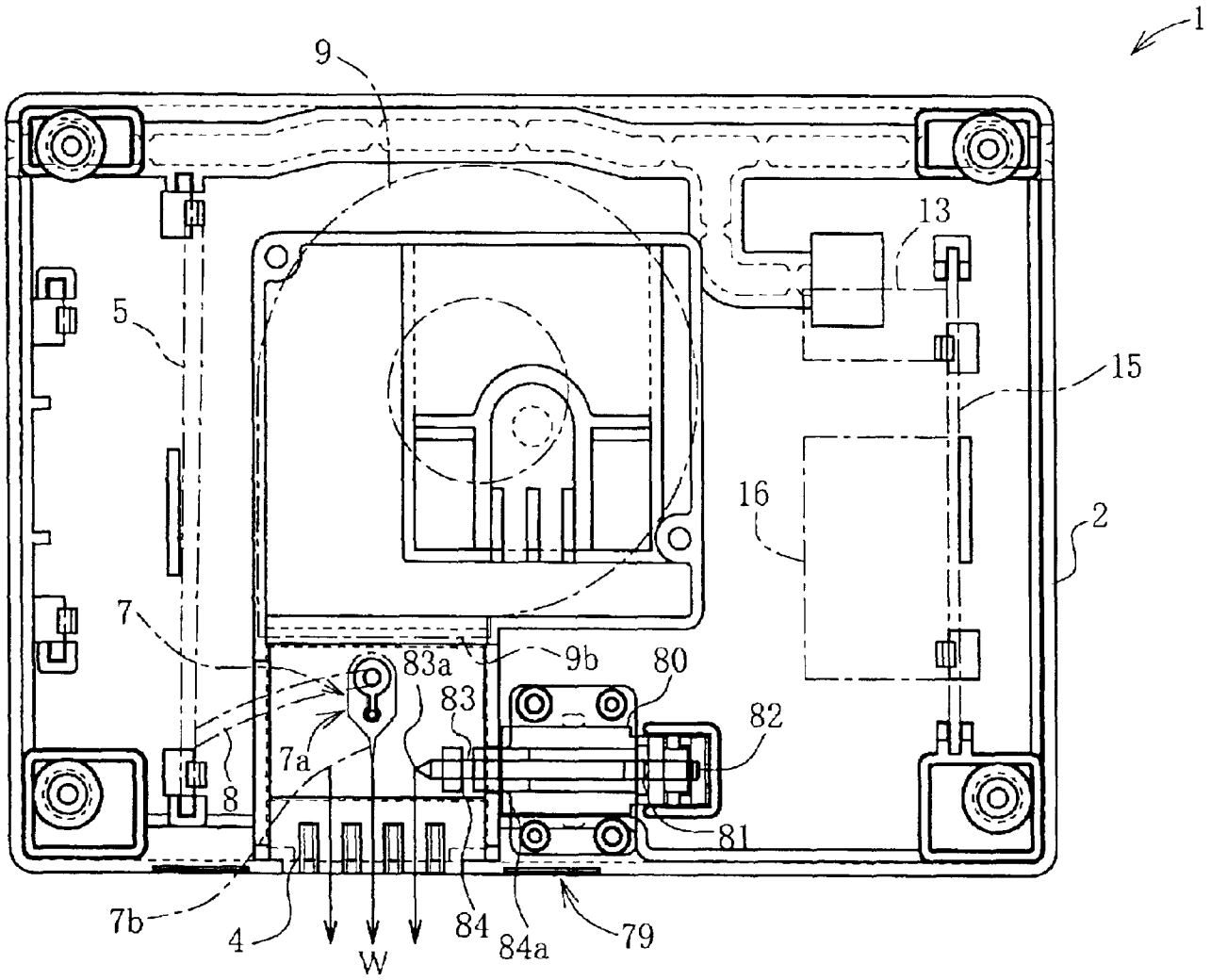
FIG. 2 is a plan sectional view of FIG. 1.

FIG. 2 is a plan sectional view of FIG. 1. An ion generating electrode 7 and a main circuit unit for ion generation 5 are provided within the case 2. The ion generating electrode 7 has a sharpened end made of a metal such as Ni or Ni alloy. In the example shown here, the ion generating electrode 7 has a main body portion 7*a* and a sharp discharge portion 7*b* integrated thereto to thereby form a plate form as a whole, and is attached to the case 2 typically with screws tightened in the main body portion 7*a*.

Figure 6A:
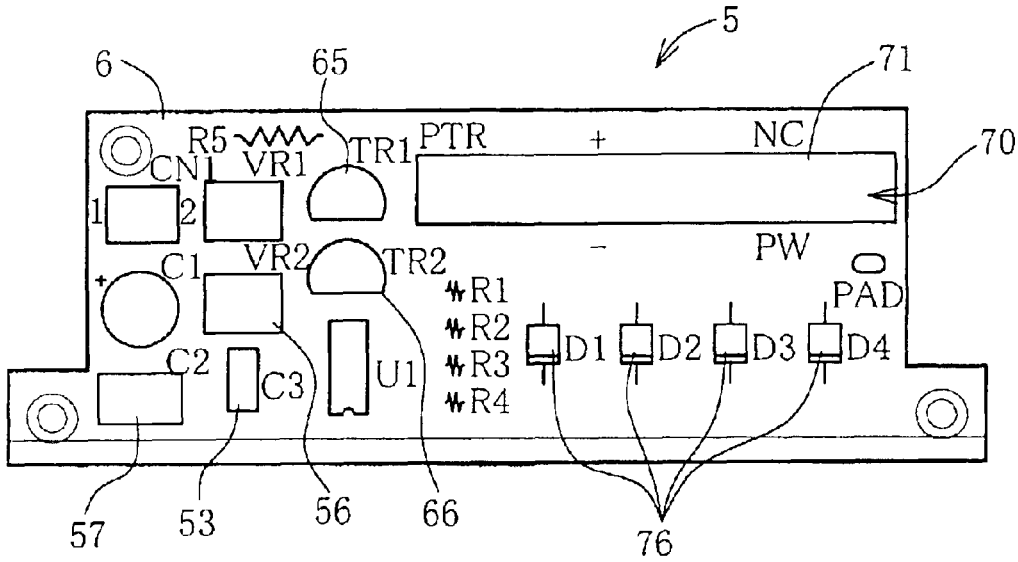
FIG. 6A is a plan view of a main circuit unit for ion generation.
Figure 6B:
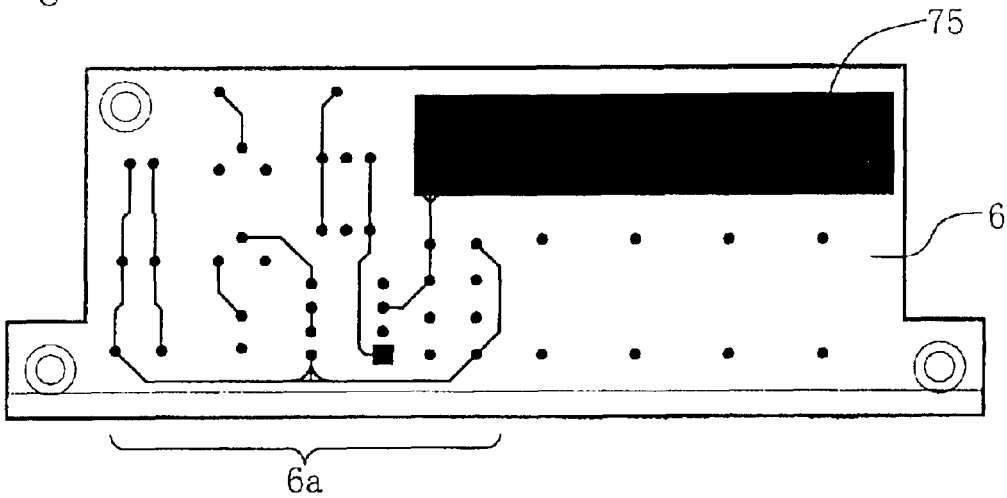
FIG. 6B is a back perspective diagram of the main circuit unit for ion generation.
Figure 6C:
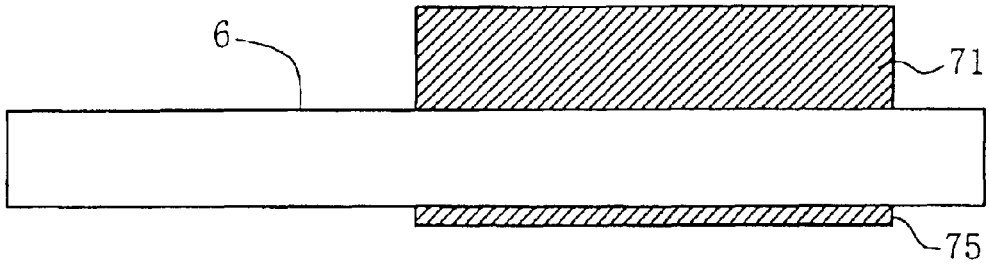
FIG. 6C is a transverse sectional view of the main circuit unit for ion generation.

The main circuit unit for ion generation 5 is a unit for applying high voltage for the ion generation to the ion generating electrode 7 via a high-voltage cable 8, and comprises an insulated board 6 and circuit parts mounted thereon as shown in FIGS. 6A to 6C. As shown in FIG. 2, the case 2 has enclosed therein an air blower 9 for generating an air flow W running by the ion generating electrode 7 towards such ion emitting hole 4, which blower is typically located at the rear portion of the ion generating electrode 7. The air blower 9 feeds air flow generated by rotation of a blower blades, not shown, through a blowout hole 9*b* towards the ion generating electrode 7, to thereby enhance emission of ions generated here out from the ion emitting hole 4.

Figure 3:
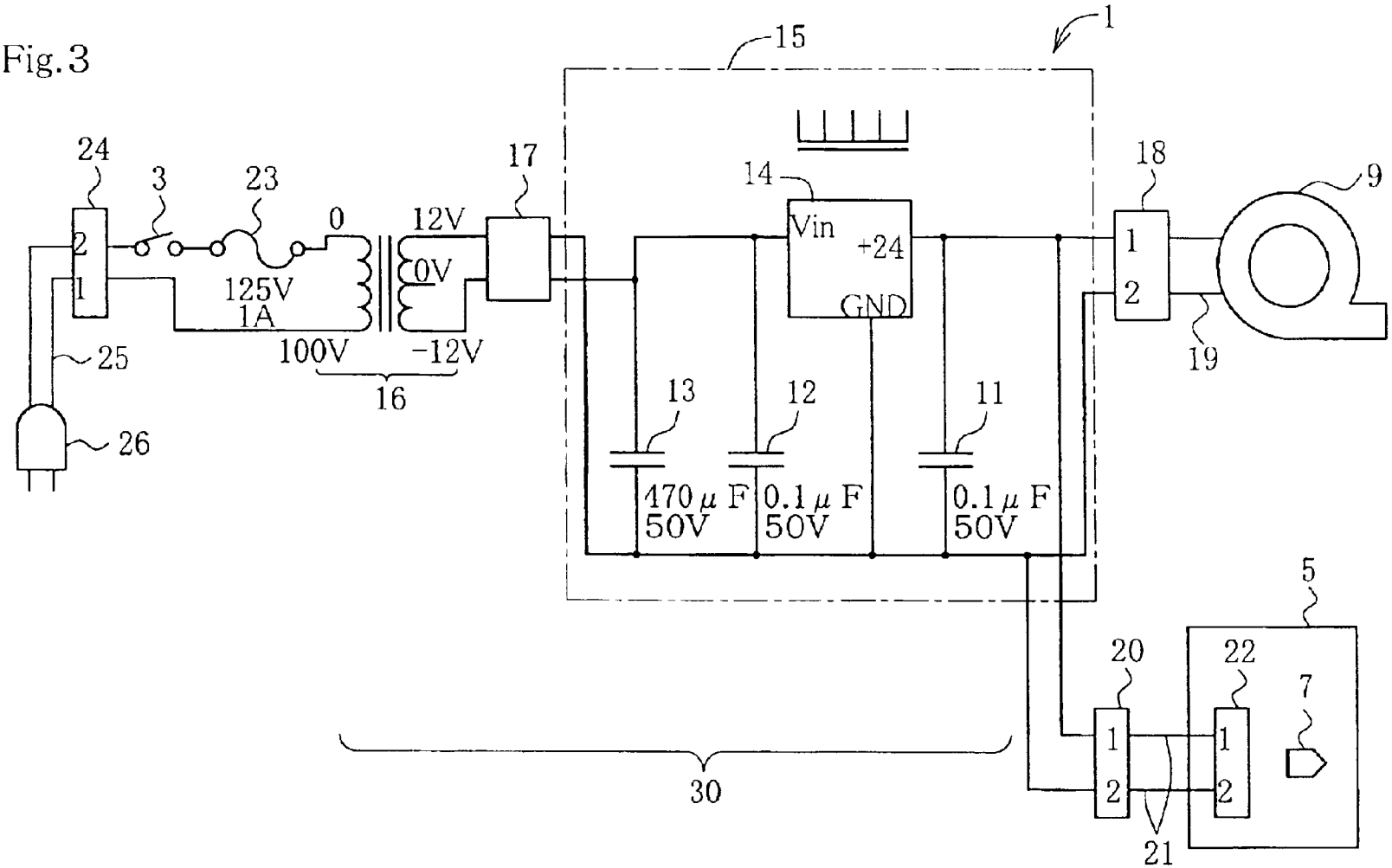
FIG. 3 is a circuit diagram showing an exemplary entire constitution of an electric system of the ion generation apparatus shown in FIG. 1.

FIG. 3 shows an entire circuit constitution of the ion generation apparatus 1, in which the air blower 9 and a main circuit unit for ion generation 5 are connected to a power source unit 30 through connectors 18, 20 and connection cables 19, 21, respectively. The power source unit 30 is also connected with a power source plug 26 and a power source cord 25 through a connector 24, through which the apparatus 1 can be supplied with electric power from an external AC power source (e.g., AC 100 V) not shown. In the power source unit 30, AC input power received via the power source switch 3 and a fuse 23 is stepped down to a predetermined voltage (e.g., 32 V in peak-to-peak) by a transformer 16, subjected to full-wave rectification by a diode bridge 17, stabilized in the voltage thereof by a stabilizing portion 15 which is composed of capacitors 11 to 13 and a three-terminal regulator 14, and is then divided for the air blower 9 and main circuit unit for ion generation 5.

Figure 4:
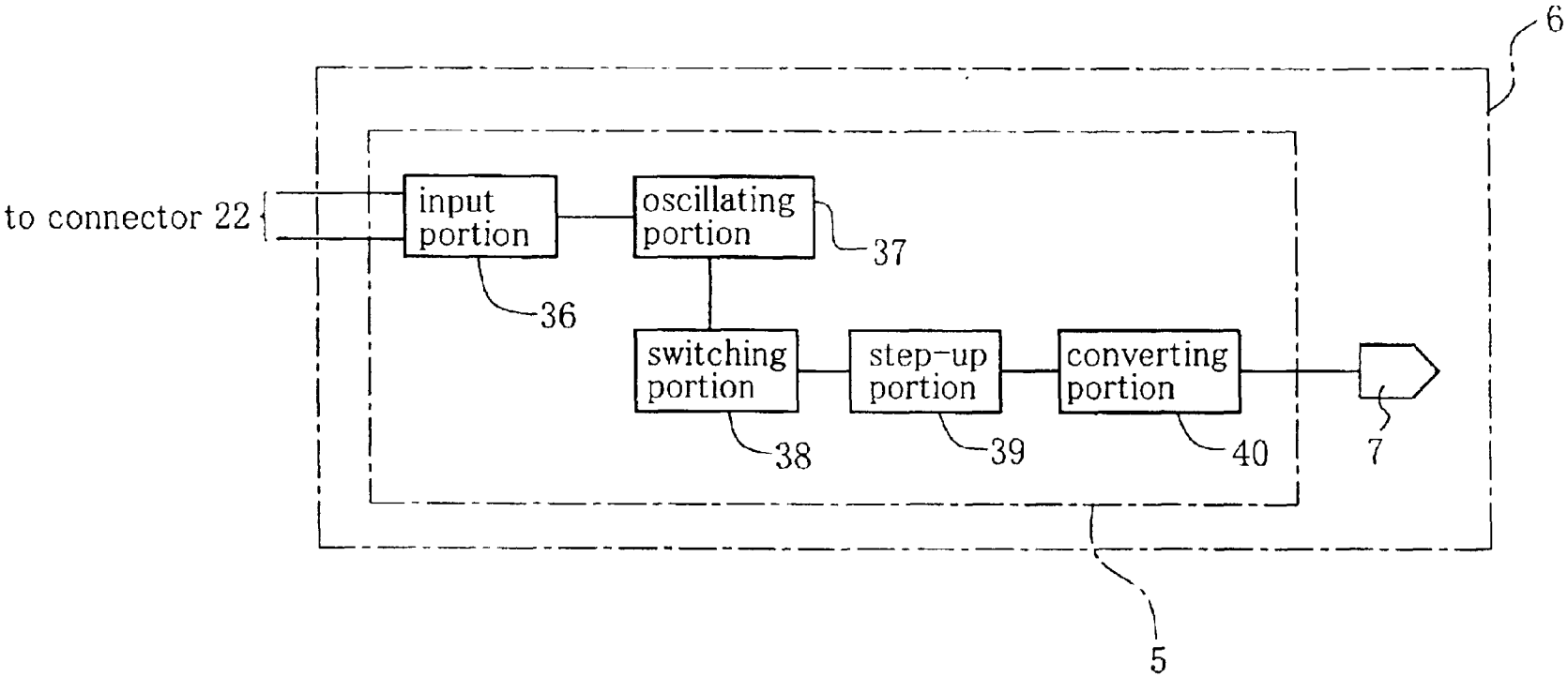
FIG. 4 is a block diagram showing a circuit constitution of the ion generation unit of the apparatus.
Figure 5:
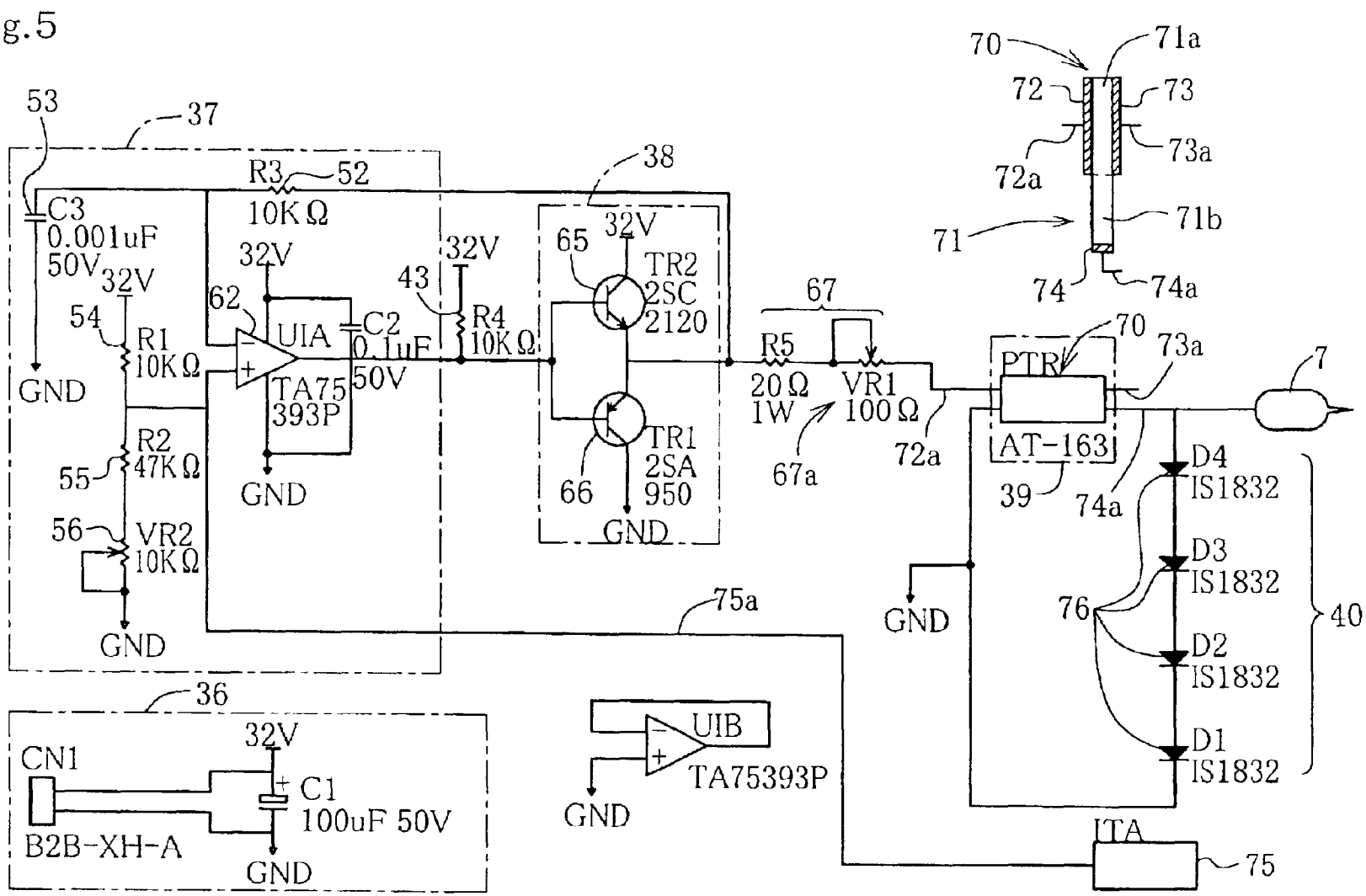
FIG. 5 is a circuit diagram showing an exemplary detail of the constitution shown in FIG. 4.

The main circuit unit for ion generation 5 functions as a high voltage generating portion for applying high voltage to the ion generating electrode, and comprises, as shown in FIG. 4, an input portion 36, an oscillating portion 37, a switching portion 38, a step-up portion 39 and a converting portion (polarity conversion means) 40. FIG. 5 shows an example of a specific circuit constitution. The step-up portion 39 is composed so as to include a piezoelectric transformer 70, where such piezoelectric transformer 70 has on a piezoelectric ceramic device board 71 input terminals 72*a*, 73*a* and an output terminal 74*a*, whereby primary AC input voltage applied to the input terminals 72*a*, 73*a* is raised by being mediated by mechanical vibration of such piezoelectric ceramic device board 71 to the secondary AC output voltage to be output through the output terminal 74*a* towards the ion generating electrode 7. The converting portion 40 is responsible for converting polarity of the secondary AC output from the piezoelectric transformer so as to ensure negative predominance of the polarity of voltage applied to the ion generating electrode 7. This allows the ion generating electrode 7 to function mainly as a negative ion generation source.

The input portion 36 is responsible for dividing DC constant-voltage input from the power source unit 30 to various portions of the circuit via a regulatory resistor, not shown. The oscillating portion (oscillation circuit) 37 receives DC constant-voltage input and then generates oscillation waveform at a frequency corresponded to the primary AC input to the piezoelectric transformer 70. The oscillating portion 37 in this embodiment is composed as a square-wave oscillating circuit comprising an operating amplifier 62, a resistor 52 on the feedback side, and a capacitor 53. Resistors 54, 55 and 56 are provided for defining a reference voltage of the oscillation input, that is a central value for an amplitude of the oscillation voltage, and values of which can be altered with the aid of a variable resistor 56.

The switching portion (switching circuit) 38 performs high-speed switching of the DC constant-voltage input from the power source unit 30 upon receiving the waveform signal from the oscillating portion 37, to thereby generates an input AC waveform to be input to the primary side of the piezoelectric transformer 70. More specifically, the switching portion 38 is composed as a push-pull switching circuit including a pair of transistors 65, 66. These transistors 65, 66 turn ON or OFF according to the output from the operating amplifier 62 (here 43 represents a pull-up resistor), to thereby generate a square AC waveform oscillating at an oscillation frequency of the oscillating portion 37. Such waveform is input to the primary side of the piezoelectric transformer 70.

The piezoelectric ceramic device board 71 of the piezoelectric transformer 70 has a laterally elongated plate shape, which is divided at the middle point of the longitudinal direction thereof into a first plate-formed zone 71*a* polarized in the thickness-wise direction of the plate, and into a second plate-formed zone 71*b* polarized in the longitudinal direction of the plate. On such piezoelectric ceramic device board 71, a pair of input electrodes 72, 73 to which the input terminals 72*a*, 73*a* will respectively be connected are formed so as to cover both surfaces of the first plate-formed zone 71*a*, and an output electrode 74 to which the output terminal 74*a* will be connected is formed on the end plane in the longitudinal direction of the plate of the second plate-formed zone 71*b*.

When AC input is supplied via the pair of input electrodes 72, 73 to the first plate-formed zone 71*a* in such composed piezoelectric transformer 70, wave of the plate vibration which propagates along the longitudinal direction will strongly couple with the electric field in the thickness-wise direction since the polarization in the first plate-formed zone 71*a* is directed to the thickness-wise direction, so that a most part of the electric energy is converted into a wave energy of the plate vibration propagating along the longitudinal direction. The plate vibration along the longitudinal direction will also propagate to the second plate-formed zone 71*b*, where the polarization is directed in the longitudinal direction, and will strongly couple with the electric field in the longitudinal direction. When an AC frequency is corresponded (more preferably agreed) with a resonance frequency of such mechanical vibration of the piezoelectric ceramic device plate 71, impedance of the device plate 71 will be nearly minimum (resonance) on the input side and nearly maximum (anti-resonance) on the output side, so that the primary input is raised to secondary output at a step-up ratio according to such impedance conversion ratio.

The piezoelectric transformer 70 having such principle of operation is advantageous in that having a simple structure, and that being composed as an extremely lightweight and compact device as compared with iron-cored, wire-wound transformer. It is also advantageous in that ensuring an excellent impedance conversion efficiency under a large load, so that a stable and excellent step-up ratio will be attained. It is still also advantageous for the ion generating apparatus which is operated by nature under a condition approximated to load open, except during a period of generating discharge current associated with the ion emission, in that a high voltage suitable for the ion generation can stably be generated, which allows effective use of the foregoing merits specific to the piezoelectric transformer.

With regard to materials possibly composing the piezoelectric ceramic device plate 71, perovskitic piezoelectric ceramic of lead zirconate titanate base (so-called PZT) is typically used in this embodiment. This ceramic is mainly composed of solid solution of lead zirconate and lead titanate, and is preferably used in the present invention by virtue of its excellent impedance conversion efficiency. Compounding ratio expressed by (lead zirconate)/(lead titanate) in molar basis is preferably 0.8 to 1.3 or around in order to attain a desirable impedance conversion efficiency. It is also allowable to optionally substitute a part of zirconium or titanium typically with Ni, Nb, Mg, Co or Mn.

It is to be noted now that the piezoelectric ceramic device board of PZT base will suddenly be ruined in its resonance sharpness under extremely high operation frequencies to thereby lower the conversion efficiency, so that the frequency of the primary AC input is preferably set to a value corresponded to the mechanical vibration frequency of the device board 71 within a relatively low frequency range of 40 to 300 kHz or around. Conversely, the dimension of the device board 71 is preferably be determined so that the mechanical resonance frequency thereof will fall within the above frequency range.

In the case that the PZT-base piezoelectric ceramic device board is used, the voltage level of the primary AC input is preferably set within a range from 15 to 40 V or around in view of ensuring a desirable level of the negative ion generation efficiency and durability of the device board. This will successfully ensure a level of approx. 500 to 3,000 V (typically 2,000 V) for the voltage to be applied to the ion generating electrode 7, while considering the foregoing frequency range (approx. 40 to 300 kHz) of the primary AC input.

The conversion portion 40 has provided therein a diode 76 as a rectifying means. The diode 76 rectifies the secondary AC output from the piezoelectric transformer 70 in such a way that permitting charge transfer in a direction responsible for charging up the ion generating electrode 7 in a negative polarity and forbidding charge transfer in the counter direction. In this embodiment, an end of output wire 74*b* lead out from the output terminal 74*a* of the piezoelectric transformer 70 is grounded, which wire is branched at the midpoint thereof to be connected to the ion generating electrode 7, and has diodes 76 connected therein on the downstream side of the branched point for the ion generating electrode 7. A plurality of diodes 76 (in the number of 4, for example) are serially connected in this embodiment in order to ensure a desirable voltage resistance.

A feedback capacitance is provided on a route 75*a* responsible for feeding the secondary AC output from the piezoelectric transformer 70 back to the oscillating portion (oscillation circuit) 37. The piezoelectric transformer 70 must keep the operation frequency thereof within a relatively narrow range centered by the resonance frequency of the piezoelectric ceramic device board 71 for stabilization of the operation. Providing such feedback capacitance is advantageous in that stabilizing the operation frequency of the piezoelectric transformer 70.

In this embodiment, as shown in FIG. 6A to FIG. 6C, the piezoelectric transformer 70 is assembled on an insulating board 6 so as to keep a piezoelectric ceramic device board 71 and such insulating board 6 in parallel. The insulating board 6 is composed, for example, of a glass-fiber-reinforced plastic plate. The back surface of such insulating board 6 is covered with a metal film electrode 75 in an area corresponded to the piezoelectric ceramic device board 71, and such metal film electrode 75 and the piezoelectric ceramic device board 71, together with the portion sandwiched between them, form a feedback capacitance. FIG. 6A is a plan view of the front surface, FIG. 6B is a perspective diagram showing a layout of the back surface as seen through the front surface, and FIG. 6C is a transverse sectional view. While the feedback capacitance may be composed as a single capacitor part, utilizing the piezoelectric ceramic device board 71 as a component of the feedback capacitance can omit the capacitor part, which is beneficial for downsizing of the board. The parallel assembly of the piezoelectric ceramic device board 71 and the insulating board 6 can contribute to further downsizing since unnecessary dead space hardly remains. Reference numeral 6*a* represents a wiring pattern for mounted parts.

Assuming a use as a negative ion generating apparatus in general living goods, it is preferable to ensure an amount of generation of negative ions measured at a position 1 m away frontward from the end of the ion generating electrode 7 is 100,000 ions/$cm^3$ or more in view of fully bringing out the air cleaning effect, disinfectant effect and deodorizing effect. In this case, voltage applied to the ion generating electrode 7 is preferably within a range from 1,000 to 3,000 V. The secondary output voltage from the piezoelectric transformer 70 is applied to the ion generating electrode 7 in a form of negative pulsating current obtained through rectification by the conversion portion 40 as described in the above. Ion generating discharge in a form analogous to so-called silent discharge tends to produce ozone in the air. While ozone has a strong oxidizing potency and thus exhibits excellent disinfectant effect and oxidative decomposition property against organic substances, an excessive production thereof will be causative of offensive and stimulating odor. For example, too high frequency of the pulsating current (represented by AC frequency before rectification) may sometimes raise the ozone production to thereby enhance ozone odor. From this viewpoint, frequency of the pulsating current applied to the ion generating electrode 7 is preferably regulated to 150 kHz or below, which will desirably suppress the ozone generation as low as 0.1 ppm or below to thereby prevent excessive generation of ozone odor. The ozone generation in a small amount can, however, typically raise the disinfectant effect in cooperation with the negative ions. From this point of view, the amount of ozone generation is preferably controlled within a range from 0.01 to 0.04 ppm. In this case, applied voltage to the ion generating electrode 7 is preferably 1,000 to 2,500 V, and frequency of pulsating current is preferably 50 to 150 kHz. It is also advantageous, in terms of suppressing the ozone generation, to use a sharply-pointed, grounded ion generating electrode 7 essentially having no counter electrode as described in this embodiment.

As shown in FIG. 2, the ion generating electrode 7 is housed in the case 2 so as to allow the end thereof to be exposed in the ion emitting hole 4 so that generated ions can efficiently be emitted therefrom. The main circuit unit for ion generation 5 is located at a position deflected from the ion emitting hole 4 so as not to interfere the ion flow. The air blower 9 is located at a position corresponded to the ion emitting hole 4 but behind the ion generating electrode 7. Such constitution can generate wind which directly flows towards the ion emitting hole 4, and thus allows the ions generated from the ion generating electrode 7 to be emitted from the ion emitting hole 4 in an efficient manner. The air blower 9 may be located at any other position as far as wind flowing beside the ion generating electrode 7 towards the ion emitting hole 4 can be produced, where the location in front of the ion generating electrode 7 is even allowable. However in the case that generated ions are hydroxyl ions ($H_3O_2^-$), which are slightly less stable in the air than oxonium ions ($H_3O^+$), such hind location of the air blower 9 may sometimes be advantageous in that allowing more stable emission of the generated negative ions as compared with the frontal location.

In the constitution shown in FIG. 3, when DC constant voltage is supplied by plugging a power source plug 26 to a receptacle as an external AC power source and turning the power source switch 3 ON, the air blower 9 and the main circuit unit for ion generation 5 start to operate. Upon being supplied with such DC constant voltage through the input portion shown in FIG. 5, the oscillating portion 37 and switching portion 38 of the main circuit unit for ion generation 5 operate to generate square-wave AC current, which is then supplied as primary AC input for an adjusting resistor 67 (including a variable resistor 67*a* for wave-form correction) to the input terminal 72*a* of the piezoelectric transformer 70. The piezoelectric transformer 70 then steps up the input according to the operational principle described in the above, and outputs as the secondary AC output from the output terminal 74*a*.

The ion generating electrode 7 is charged up in a negative polarity when the secondary side of the piezoelectric transformer 70 outputs the negative half wave. This successfully produces an electric field gradient which is desirable for generating negative ions, and ionizes the ambient molecules, which is typified by water molecules, to thereby yield hydroxyl ions ($H_3O_2^-$) or so. This is a mechanism for producing negative ions. On the other hand, during an output period of the positive half wave, the ion generating electrode 7 attempts to discharge the negative charge towards the ground side, but such charge flow is blocked by the diode 76. Thus the ion generating electrode 7 is constantly kept in a negatively charged status, and can generate negative ions in a stable manner.

To confirm the effect of the present invention, the inventors carried out an experiment described below. The ion generating apparatus 1 shown in FIGS. 1 and 2 was composed as that having a circuit constitution shown in FIG. 5. The piezoelectric ceramic device board 71 was selected as having a composition containing lead zirconate and lead titanate in a molar ratio of 1:1, and approx. 2 wt % of Nb as an additional element, and as having a dimension of 52 mm long, 1.85 mm thick and 13 mm wide. The ion generating electrode 7 was made of a Ni plate of approx. 0.2 mm thick, and the discharge portion 7*b* thereof was sharpened over approx. 5 mm in length. A circuit board 5*a* was made of a glass-fiber-reinforced plastic plate.

Operation of the piezoelectric transformer 70 under a primary AC input frequency of approx. 70 kHz and a peak-to-peak voltage of 24 V was found to attain a voltage level of approx. 1,000 V to be applied to the ion generating electrode 7. The amount of negative ion generation was measured at a position 1 m away frontward from the end of the ion generating electrode 7 using a commercial ion counter (product of Nihon MJP Co., Ltd., No. IC-1000), which revealed the generation of negative ions at a level of 100,000 ions/$cm^3$ or above. The amount of ozone generation was also measured using a commercial ozone concentration gauge (product of Ebara Jitsugyo Co., Ltd., AET-030P), which revealed the generation of ozone at a level of as low as 0.01 to 0.21 ppm without any sensible odor of ozone.

While the ion generating apparatus shown in FIG. 1 was proposed as having assembled in the case 2 the air blower (sirocco fan) 9 for sending the air flow W towards the ion generating electrode 7, it is also allowable to adopt a constitution in which an ion generating mechanism is assembled with an air conditioner for heating and cooling to thereby allow the generated ions to be mixed with the conditioned air. More specifically, such air conditioner is composed as having an air conditioning mechanism which is responsible for producing conditioned air through cooling or heating of the air flow W using a refrigerating cycle mechanism, and as using the ion emitting hole 4 also as a blow-off hole of such conditioned air.

FIG. 21A shows a schematic presentation of such air conditioning mechanism 200. The refrigerating cycle mechanism mainly comprises a main piping 199 for coolant gas having a closed circuit constitution, a compressor 205 provided on the route of such piping for compressing such coolant gas, a condenser 206 for cooling and liquefying the compressed coolant gas with the aid of a radiator 208, a decompressor 207 which mainly comprises a decompressing throttle mechanism and is responsible for decompressing the liquefied coolant gas, and an evaporator 204 for bringing the decompressed coolant gas and the air flow to be cooled into contact indirectly as being partitioned by the pipe wall, to thereby cool the air flow by extracting heat therefrom, which extracted heat is consumed as heat of vaporization of the coolant gas. Detailed description of such refrigerating cycle mechanism will not be given here since the mechanism per se is already known.

As shown in FIG. 21C, the evaporator 204 is enclosed in an air conditioner case 201, and will come into contact with an external air inhaled with the aid of a fan 209 from an air inlet 201*c* provided to such air conditioner case 201 through a filter F to thereby cool the air, and such cooled air will be blown out through a blow-off duct 201*a* from a blow-off hole 201*d* as a conditioned air flow W. While the above description dealt with the case of cooling, the air conditioning mechanism can also be used for heating if the compressor 205 is designed so as to allow reversible feeding direction of the compressed coolant gas, and exchanging functions of the condenser 206 and evaporator 204 during the inverted operation, which enables heating and blowing of the external air by the evaporator 204 whose function was converted from that of the compressor 206.

The conditioned air is brought into contact with the ion generating electrode 7 arranged on an attachment portion 203 placed in the blow-off duct 201*a* as the enclosure, and is then blown off as the conditioned air flow containing negative ions. It is now also allowable, as shown in FIG. 21B, to provide a plurality of ion generating electrodes 7 within the blow-off duct 201*a* for the purpose of increasing amount of negative ions contained therein. In such case, the main circuit unit for ion generation 5 may be provided in a plural number so as to respectively be corresponded to the individual ion generating electrodes 7. In the case that the blow-off volume of the air flow is regulative based on the number of rotation of the fan, it is also allowable to increase or decrease the number of pairs of such ion generating electrodes 7 and main circuit units for ion generation 5 operated at the same time. More specifically, it is also allowable to compose the apparatus so that a larger number of the pairs of ion generating electrodes 7 and main circuit units for ion generation 5 will result in a larger volume of the blown air.

The embodiment having been described in the above is also applicable to an ion generating apparatus which is not specifically provided with an electric cleaning mechanism for the ion generating electrode described below.

The ion generating apparatus 1 shown in FIG. 1, or air conditioning mechanism 200 incorporating a similar ion generating unit, is provided with an electric cleaning mechanism 79 responsible for burning out attachment adhered to the ion generating electrode 7 through electric heating, where the attachment is more specifically such that comprising dust, oil component and other dirt. The electric cleaning mechanism 79 specifically comprises a spark-discharge counter electrode 83 for spark discharge as being opposed to the ion generating electrode 7. A high-voltage generating portion for ion generation which comprises the step-up portion 39, inclusive of the piezoelectric transformer 70, and a conversion portion 40 functions also as the spark-discharge, high-voltage generating portion, where a gap formed between the ion generating electrode 7 and spark-discharge counter electrode 83 is applied with high voltage for spark discharge. Spark-by-discharge generated between the ion generating electrode 7 and spark-discharge counter electrode 83 by such high voltage application will successfully burn out the attachment adhered on the ion generating electrode 7. While the spark-discharge counter electrode 83 may be grounded, the grounding is not always necessary since the discharge current can be absorbed by capacitance of the apparatus if the spark discharge occurs only in a short period.

The spark-discharge counter electrode 83 is arranged so-as to be opposed to the end portion 7*a* of the ion generation electrode 7. More specifically, the spark-discharge counter electrode 83 is designed to have a rod shape, and the end plane or lateral plane (which applies to this embodiment) of such rod-shaped, spark-discharge counter electrode is opposed to the end portion 7*a* of the ion generating electrode 7.

Figure 8A:
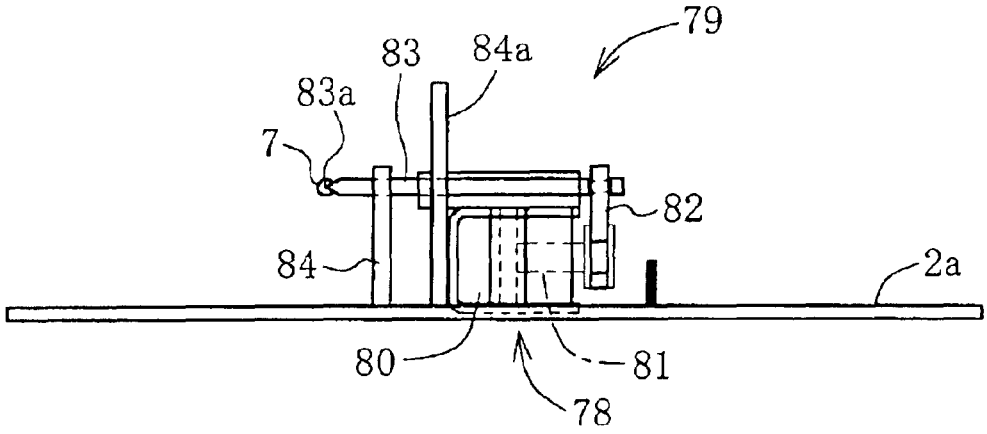
FIG. 8A is a side view of an exemplary moving mechanism for the spark-discharge counter electrode together with operations thereof.
Figure 8B:
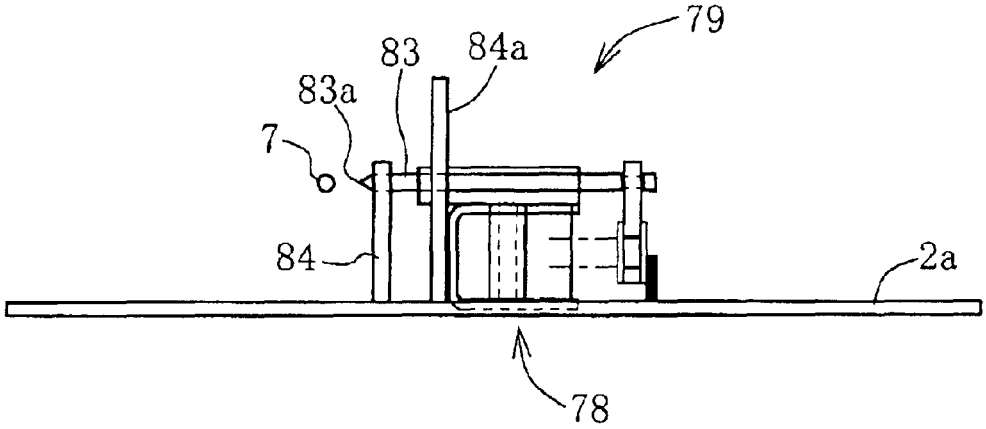
FIG. 8B is a drawing explaining operation as continued from FIG. 8A.

In the example shown in FIGS. 8A and 8B, a moving mechanism for spark-discharge counter electrode 78 is provided, where which mechanism is responsible for relatively moving the spark-discharge counter electrode 83 closer to or more distant from the ion generating electrode 7 at least between a furthest position allowing ion generation from the ion generate electrode 7 (FIG. 8B) and a closest position allowing generation of the spark-by-discharge between the spark-discharge counter electrode 83 and ion generating electrode 7 (FIG. 8A). The moving mechanism for spark-discharge counter electrode 78 herein is composed so as to move the spark-discharge counter electrode 83 while keeping the position of the ion generating electrode 7 unchanged.

As shown in FIG. 2, the electric cleaning mechanism 79 is placed aside with regard to the ion emissive direction of the ion generating electrode 7, and the moving mechanism for spark-discharge counter electrode 78 is designed so as to allow the rod-shaped, spark-discharge counter electrode 83 to move closer to or distant from the ion generating electrode 7 along an axial direction which is approximately normal to the direction viewing the end of the ion generating electrode 7 at front ways (i.e., ion emissive direction). Such arrangement is advantageous since the spark-discharge counter electrode 83 recessed to a refuge position will hardly interfere the ion blow emitted from the end of the ion generating electrode 7.

More specifically, the moving mechanism for spark-discharge counter electrode 78 contains a solenoid 80 attached to the bottom portion 2*a* of the case 2, where on the end of a reciprocating rod 81, the rear end portion of the rod-shaped, spark-discharge counter electrode 83 is bound via a binding member 82, so that reciprocating motion of the reciprocating rod 81 driven by the solenoid 80 will move the front end portion of the spark-discharge counter electrode 83 closer to or away from the end portion of the ion generating electrode 7. A reference numeral 84*a* herein represents a positioning plate to fix a solenoid 80. A reference numeral 84 herein represents a guide plate having a guide hole through which the spark-discharge counter electrode 83 is inserted, whereby the spark-discharge counter electrode 83 can move closer to or away from the ion generating electrode 7 approximately in a horizontal manner, which eventually improves accuracy in gap forming for spark discharge.

Figure 7:
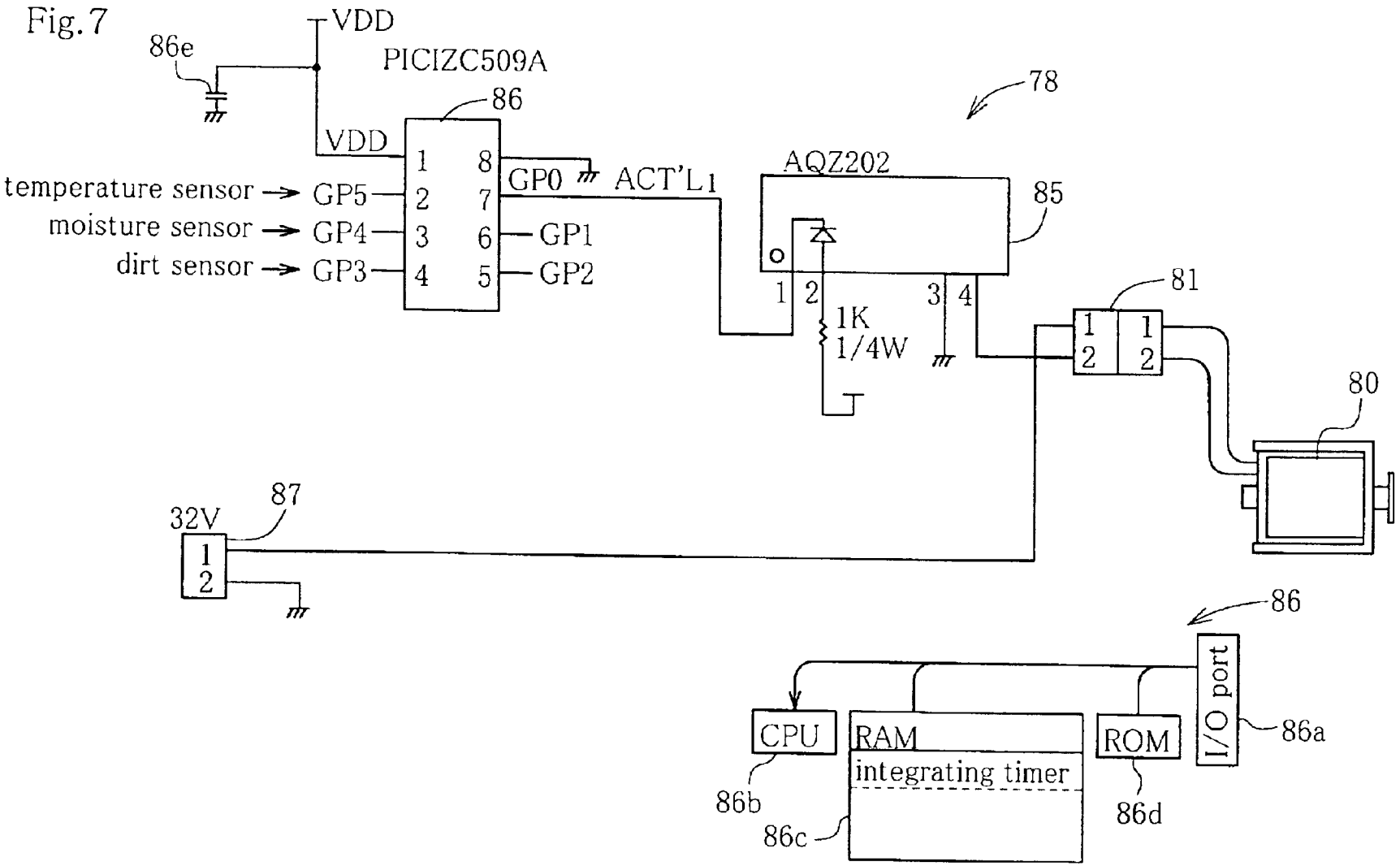
FIG. 7 is a circuit diagram showing an exemplary electric cleaning mechanism.

FIG. 7 is a circuit diagram showing an exemplary electric constitution of the moving mechanism for spark-discharge counter electrode 78. The solenoid 80 is connected to a DC power source thorough a connector 87. In this embodiment, also the main circuit unit for ion generation 5 uses the same power source (DC 32 V, herein). On the other hand, an energizing signal for the solenoid 80 is supplied from a control portion 86 through a switch mechanism 85 (herein composed of a photo MOS). The control portion 86 comprises a microprocessor having integrated therein an I/O port 86*a*, and a CPU 86*b*, RAM 86*c* and ROM 86*d* connected to such I/O port 86*a*. The ROM 86*d* has stored therein an operation control program for the moving mechanism for spark-discharge counter electrode 78. The CPU 86*b* functions as a principal for the operational control of the moving mechanism for spark-discharge counter electrode 78 by executing such operation control program using RAM 86*c* as a work area. When an operation command signal for the moving mechanism for spark-discharge counter electrode 78 is issued by the control portion 86, the photo MOS 85 turns ON, and the solenoid 80 is energized upon being applied with DC operation voltage.

Figure 13A:
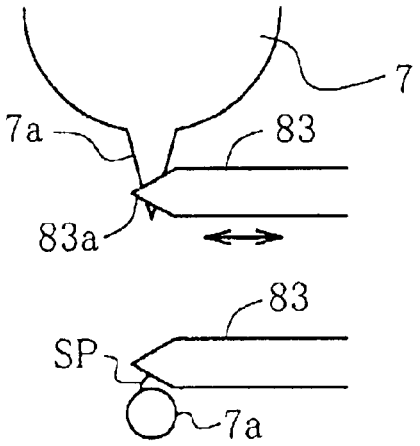
FIG. 13A is a schematic drawing showing various motional pattern of the spark-discharge counter electrode with respect to the ion generating electrode.

As shown in FIG. 13A, the spark-discharge counter electrode 83 approaches the ion generating electrode 7 as being energized by the solenoid 80, and at the forward limiting position, the end portion 83*a* of the spark-discharge counter electrode 83 is positioned so that a gap of a predetermined width is formed between such end portion 83*a* and the end portion 7*a* of the ion generating electrode 7 on either side in the thickness-wise direction of the electrode. In such arrangement, applying discharge voltage for the ion generation, which typically amounts 1,000 to 3,000 V, to the ion generating electrode 7 will activate spark-by-discharge SP in the gap, and heat of such spark will be concentrated to thereby burn out the attachment such as dust and dirt adhered on the end portion 7*a* of the ion generating electrode 7. On the contrary, the gap g increases as the spark-discharge counter electrode 83 recesses, and generation of the spark-by-discharge will be discontinued when the gap g exceeds a sustainable limit for spark discharge $g_{max}$. However, the ion generating electrode 7, while still being applied with voltage for ion generation, can immediately swith into an ion generation mode upon discontinuation of the spark discharge.

Figure 13B:
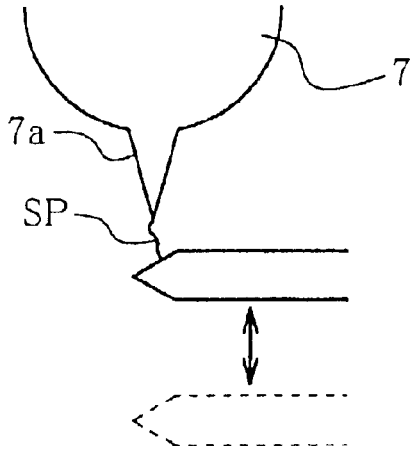
FIG. 13B is a explanatory drawing as continued from FIG. 13A.
Figure 13C:
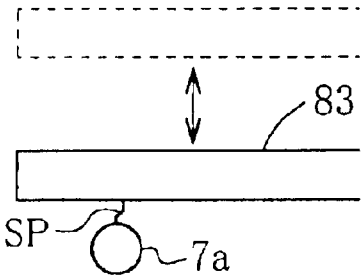
FIG. 13C is a explanatory drawing as continued from FIG. 13B.
Figure 13D:
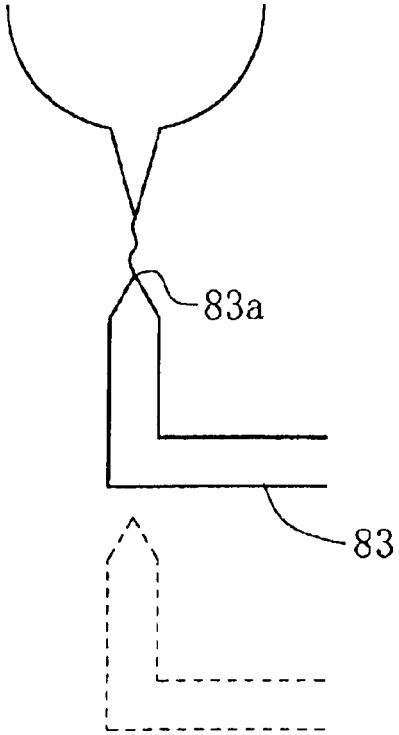
FIG. 13D is a explanatory drawing as continued from FIG. 13C.

It is to be noted that modes of the gap formation for spark discharge, and modes of the approaching and departing of the spark-discharge counter electrode 83 relative to the ion generating electrode 7 are not limited to those described in the above embodiment, and other various modes are allowable. FIG. 13B shows an exemplary case in which the end of the ion generating electrode 7 is opposed to the side plane of the end portion of the spark-discharge counter electrode 83 so as to form the gap, and such spark-discharge counter electrode 83 is approached to the end of the ion generating electrode 7 from the front side or departed therefrom (or may be approached or departed in the thickness-wise direction of the ion generating electrode 7). The FIG. 13C shows another exemplary case in which the end of the ion generating electrode 7 is opposed to the side plane of the middle portion of the spark-discharge counter electrode 83 so as to form the gap, and such spark-discharge counter electrode 83 is approached or departed in the thickness-wise direction of the ion generating electrode 7. FIG. 13D shows still another exemplary case in which the bent end portion 83*a* of the spark-discharge counter electrode 83 is approached to or departed from the end portion of the ion generating electrode 7 in the front side thereof.

Figure 9:
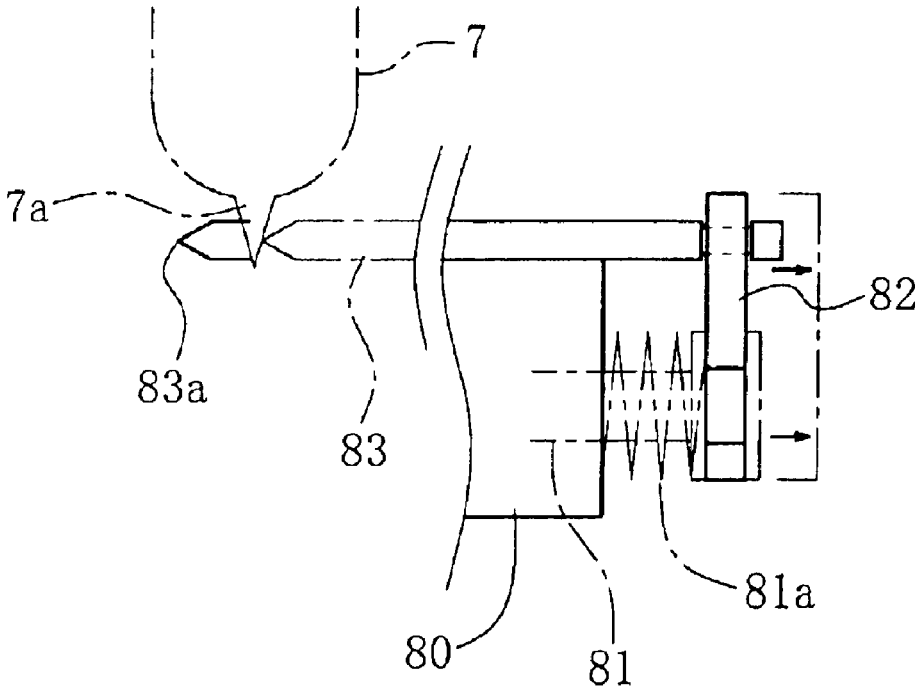
FIG. 9 is a drawing explaining a contact status of the spark-discharge counter electrode with the ion generating electrode.

All examples described in the above were such that causing the spark discharge by moving the spark-discharge counter electrode 83 from a distant position, which is defined so as to disable the spark discharge, to a proximate position where a predetermined width of gap is formed so as to enable the spark discharge. It is, however, also allowable to adopt a system as typically shown in FIG. 9 in which the spark-discharge counter electrode 83 is once brought into contact with the ion generating electrode 7, and is then recessed to thereby form the gap so as to allow the spark discharge. In such case, it is preferable to adjust the forward limiting position during the approach of the spark-discharge counter electrode 83 so as to across the position of the end portion 7*a* to thereby slightly project toward the opposite side in a free status, and so as to push back a recovery spring 81*a* for use in the energizing-released status by the solenoid 80 upon contacting with the ion generating electrode 7. This will successfully prevent an excessive pressing force to the ion generating electrode 7 from being applied by virtue of elastic deformation of the spring 81*a*.

Figure 11A:
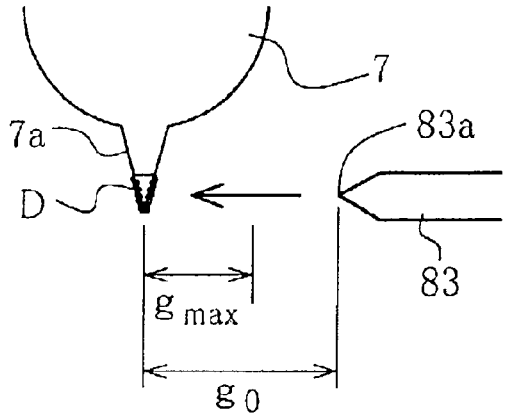
FIG. 11A is a drawing explaining a process of spark discharge activated when the spark-discharge counter electrode once contacted with the ion generating electrode is recessed.
Figure 11B:
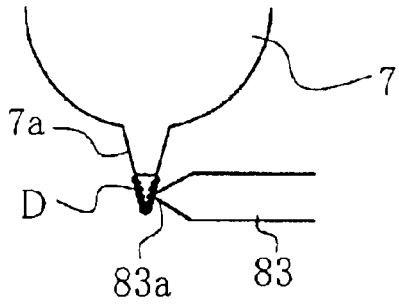
FIG. 11B is an explanatory drawing as continued from FIG. 11A.
Figure 11C:
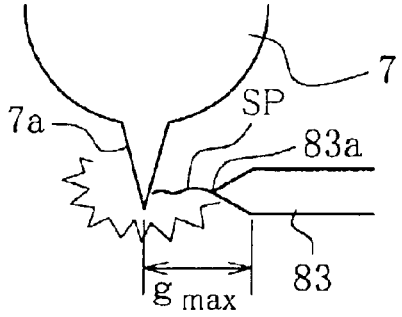
FIG. 11C is an explanatory drawing as continued from FIG. 11B.
Figure 11D:
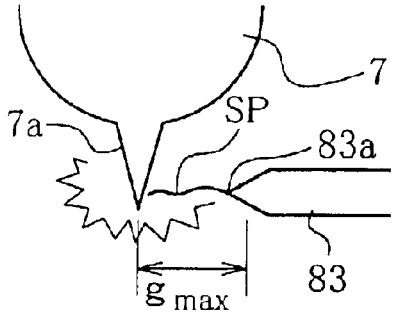
FIG. 11D is an explanatory drawing as continued from FIG. 11C.
Figure 11E:
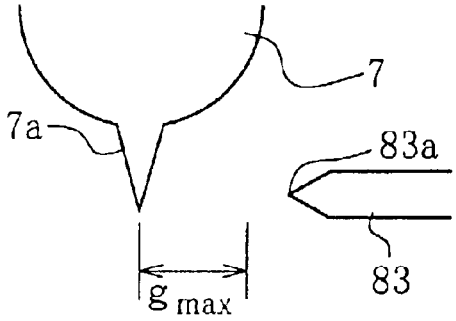
FIG. 11E is an explanatory drawing as continued from FIG. 1D.

When the status changes from the distant state as shown in FIG. 11A (where the gap equals to $g_0$ disabling the spark discharge) to the contact state shown in FIG. 11B, and when the spark-discharge counter electrode 83 starts to recess upon being released from energizing by the solenoid 80, the gap is formed between such electrode 83 and the ion generating electrode 7, to thereby immediately generate spark-by-discharge SP and burn off the attachment D. The spark-by-discharge SP is sustained until the gap distance reaches the sustainable limit for spark discharge $g_{max}$ as shown in FIG. 11D, but disappears when the gap distance exceeds $g_{max}$. For 1,000 to 2,000 V of the applied voltage, $g_{max}$ is approximately 1 mm or below.

Figure 10A:
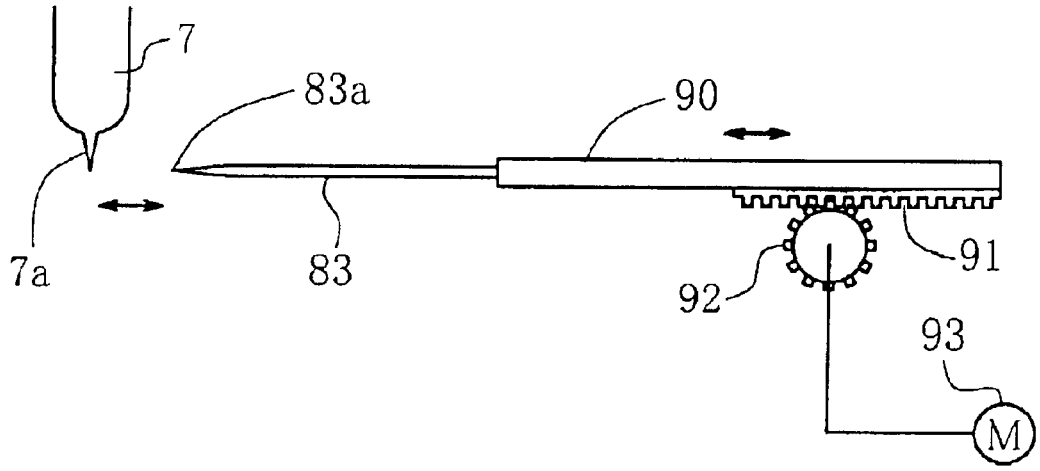
FIG. 10A is a schematic drawing showing a modified example of a moving mechanism for the spark-discharge counter electrode.

It is to be noted now that the moving mechanism for spark-discharge counter electrode 78 is not limited to that using a solenoid, where an possible example is such that using an advancing/recessing mechanism using a motor 93 as shown in FIG. 10A. In this constitution, a rack 91 is attached via a base 90 to the basal end of the spark-discharge counter electrode 83 (formed in a needle shape herein), and a pinion 92 to be engaged with the rack 91 is provided so as to be driven by a motor 93 which can rotate the pinion 92 forward or backward, and can also hold it at an arbitrary position. In the case that the spark discharge is activated by the gap formation during the recessing motion of the spark-discharge counter electrode 83 as typically shown in FIGS. 11A to 11E, the control of the rotating speed of the motor 93 enables free adjustment of the duration of time before the sustainable limit for spark discharge $g_{max}$ is reached, that is, a time period in which the spark discharge is sustained, or it is also possible to halt the spark-discharge counter electrode 83 so as to keep an arbitrary gap distance. So that it may be possible that the gap distance is narrowed to concentrate energy of the spark discharge to thereby enhance the potency of dirt removal in the case of heavy dirt adhesion or difficulty in dirt removal due to high temperature and humidity.

Figure 12A:
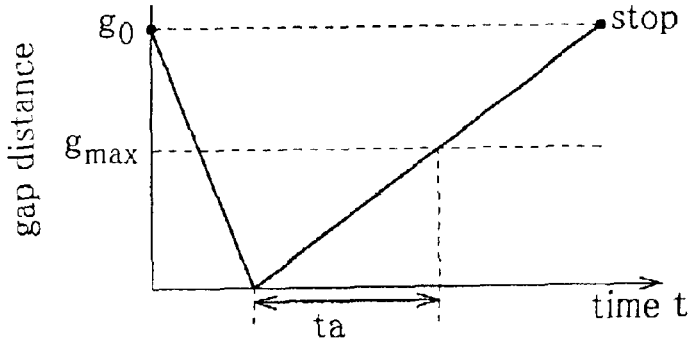
FIG. 12A is a drawing showing a first example of a control pattern for gap distance for spark discharge in relation to the movement of the spark-discharge counter electrode.
Figure 12B:
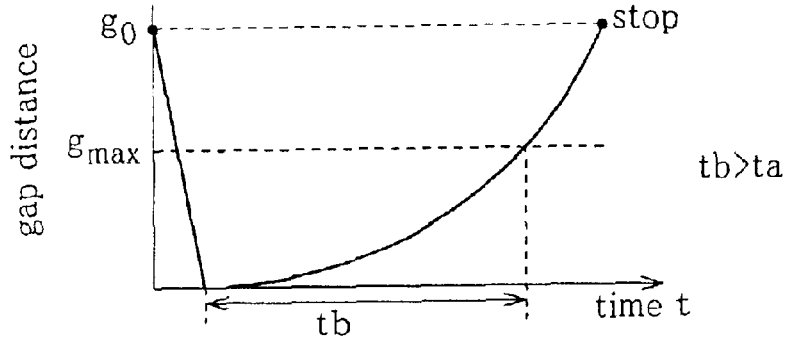
FIG. 12B is a drawing showing a second example of the same.
Figure 12C:
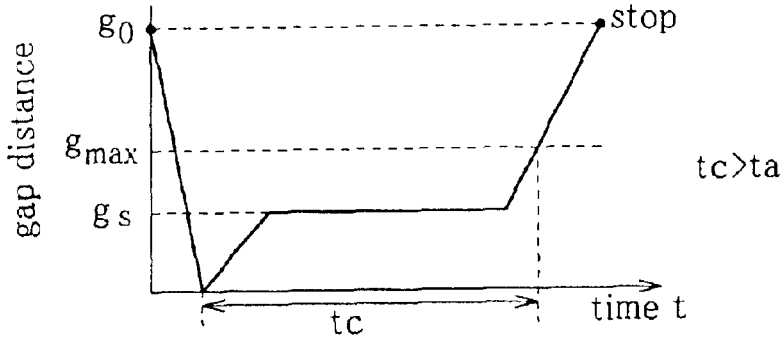
FIG. 12C is a drawing showing a third example of the same.

FIGS. 12A to 12D show various operational patterns, where the ordinate denotes the gap distance g and the abscissa denotes the time t. FIG. 12A shows a pattern in which the spark-discharge counter electrode 83 first moves from the distant position ($g=g_0$) to the contact position ($g=0$), and then moves away to gradually increase the gap distance g. Duration of time $t_a$ during which the gap distance g starts to increase from $g=0$ to $g_{max}$ represents sustainable time for spark discharge. FIG. 12B shows a pattern in which the moving speed of the spark-discharge counter electrode 83 is reduced in the initial stage to thereby increase the sustainable time for the spark discharge $t_b$ (such pattern can be attainable even with the solenoid 80 if a slow-down mechanism typically based on an oil damper is available). FIG. 12C shows a pattern in which a time period for halting the spark-discharge counter electrode 83 at a predetermined gap distance $g_s$ is provided before $g_{max}$ is attained to thereby increase the sustainable time for spark discharge $t_c$.

Figure 12D:
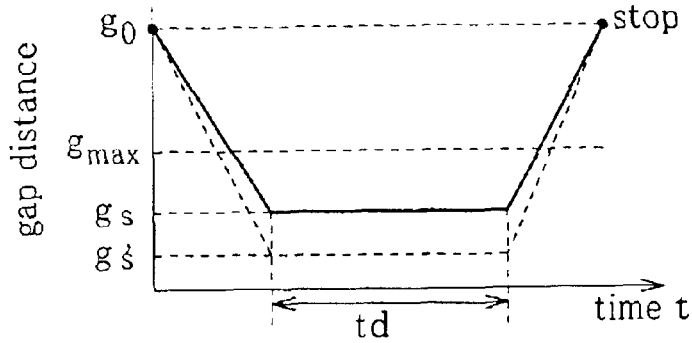
FIG. 12D is a drawing showing a fourth example of the same.

FIG. 12D shows a control pattern in which the spark-discharge counter electrode 83 is not brought into contact with the ion generating electrode 7, but is moved so as to decrease the gap distance from the initial gap distance $g_0$ to $g_s$ equals to or below $g_{max}$ for a predetermined duration of time $t_d$. In the case that difficulty in the attachment removal occurs, the gap distance $g_s$ may further be reduced to $g_s'$ as shown with dashed line in FIG. 12D.

Figure 10B:
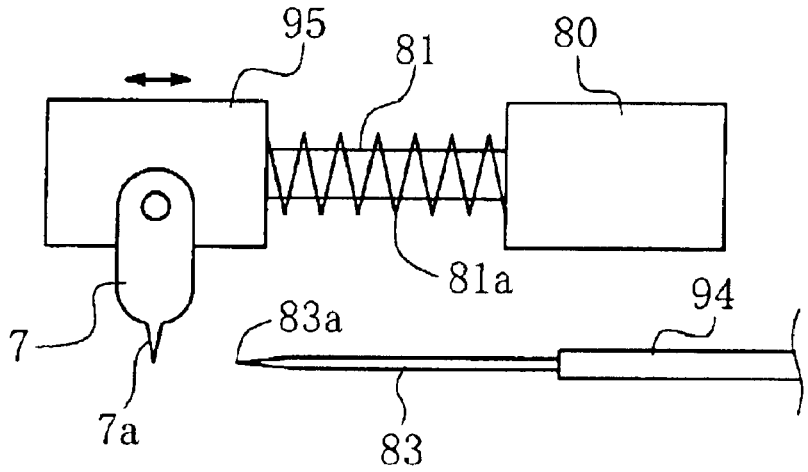
FIG. 10B is a schematic drawing showing another modified example of the same.

It is also allowable to adopt a system in which the spark-discharge counter electrode 83 is held at a fixed position, and the ion generating electrode 7 is approached thereto or departed therefrom as shown in FIG. 10B. In this case, the spark-discharge counter electrode 83 is held by a fixed base 94, and the ion generating electrode 7 is mounted on a movable base 95 which can be operated in a reciprocating manner by the solenoid 80. So that the ion generating electrode 7 can move together with the movable base 95 as being energized by the solenoid 80 towards the spark-discharge counter electrode 83.

Figure 14A:
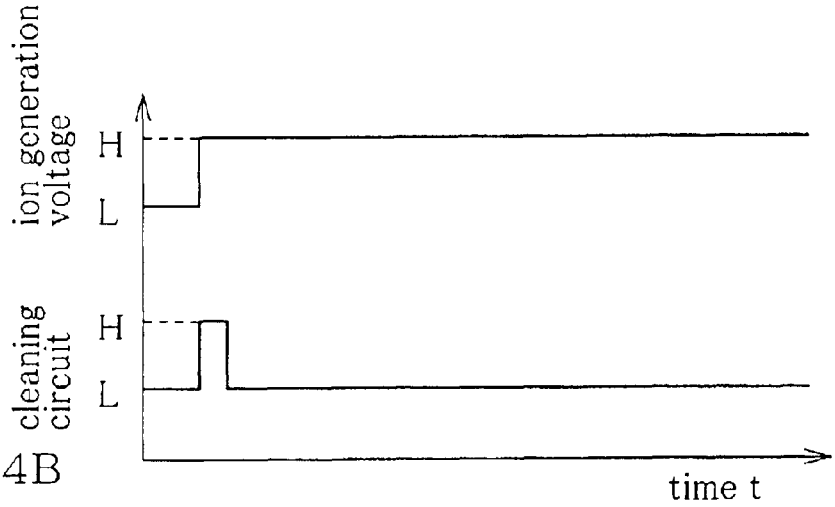
FIG. 14A is a timing chart showing an exemplary operational control of the electric cleaning mechanism.

The control portion 86 comprising the foregoing microprocessor can be used as an automatic cleaning mechanism control portion which automatically activates the electric cleaning mechanism 79 according to a predetermined timing based on a control program for the purpose of cleaning of the ion generating electrode 7. Such automatic cleaning mechanism control portion can be composed so as to activate the electric cleaning mechanism upon power supply to the ion generating apparatus. In this embodiment, when the ion generating apparatus is powered ON, the control portion 86 receives a power ON signal, which triggers the operation program for the electric cleaning mechanism 79. FIG. 14A shows an exemplary timing chart for this case, in which an operation circuit (referred to as a "cleaning circuit", hereinafter) of the cleaning mechanism is activated (operating status is expressed by "H" level) upon start of supply of ion generating voltage, to thereby effect cleaning of the ion generating electrode 7. This always ensures cleaning of the ion generating electrode 7 before the ion generating apparatus 1 is brought into the ion generation mode, so that nonconformity of interference of the ion generation due to dirt adhesion will surely be avoidable.

Figure 14B:
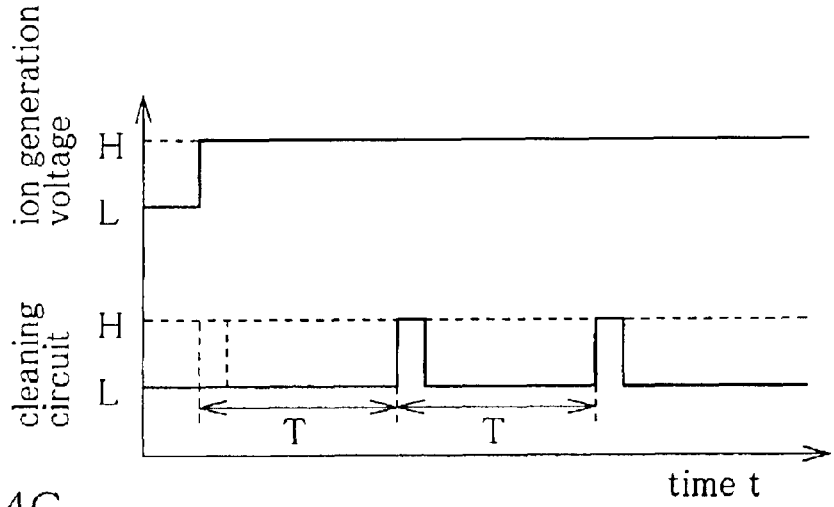
FIG. 14B is a timing chart as continued from FIG. 14A.

It is now also allowable to compose the automatic cleaning mechanism control portion in which the electric cleaning mechanism 79 is activated after a predetermined time period (T) elapsed from the power supply to the ion generating apparatus as shown in FIG. 14B. This allows the ion generating electrode 7 to more constantly be kept in a clean state since the cleaning of such ion generating electrode 7 is periodically activated during the operation of the ion generating apparatus 1.

Figure 14C:
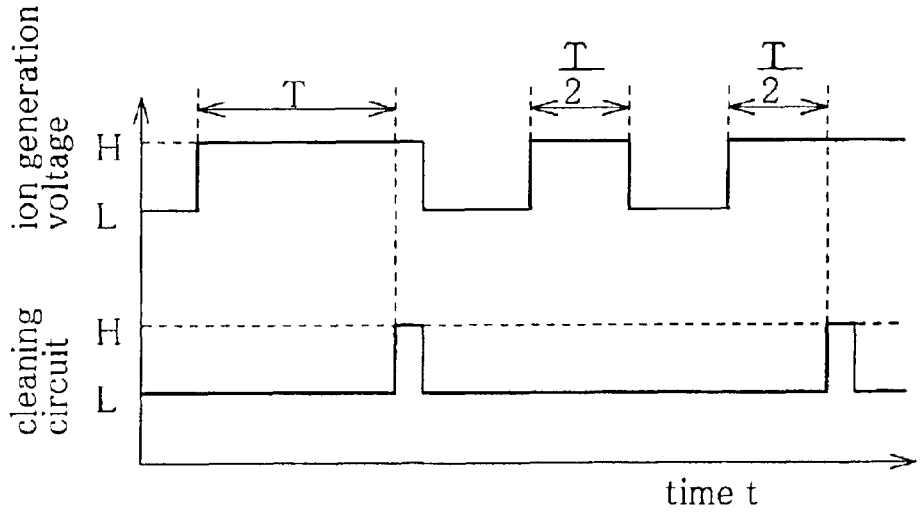
FIG. 14C is a timing chart as continued from FIG. 14B.

In such case, it is also allowable to compose the automatic cleaning mechanism control portion so as to activate the electric cleaning mechanism 79 when an integrated operating time of such ion generating apparatus reaches a predetermined value T as shown in FIG. 14C. Such composition will readily be attainable as shown in FIG. 7 based on a known timer program using a constitution in which an integrating timer memory, which functions as an integrated operating time measurement means, is provided in the RAM 86*c* of the microprocessor composing the control portion 86. A backup power source portion (typically composed of a capacitor 86*e* herein) is connected to the power source terminal of the microprocessor so as to avoid clearance of the integrating timer during the OFF state of the main power source of the ion generating apparatus 1. It is preferable to make the operation program so as to reset a measured value of the integrated operating time, that is a content of the integrating timer memory, once the cleaning is effected by the electric cleaning mechanism.

The ion generating apparatus of the present invention may also comprise an environmental status information detecting portion responding to an environmental status in which such ion generating apparatus is placed, and a cleaning mechanism operation control portion for controlling the electric cleaning mechanism based on information output from such environmental status information detecting portion. Adhesion status of the attachment on the ion generating electrode 7 and persistency thereof (or difficulty in the removal) may vary depending on the ambient aerial environment which will form the air flow. According to the above constitution, the electric cleaning mechanism will be controlled under an optimum condition so that the ion generating electrode 7 can thoroughly be cleaned based on the detection results of aerial environment obtained by the environmental status information detection portion. So that the ion generating electrode 7 can always be kept in a clean state irrespective of the ambient aerial environment, which eventually ensures a desirable state of the ion generation.

Figure 22:
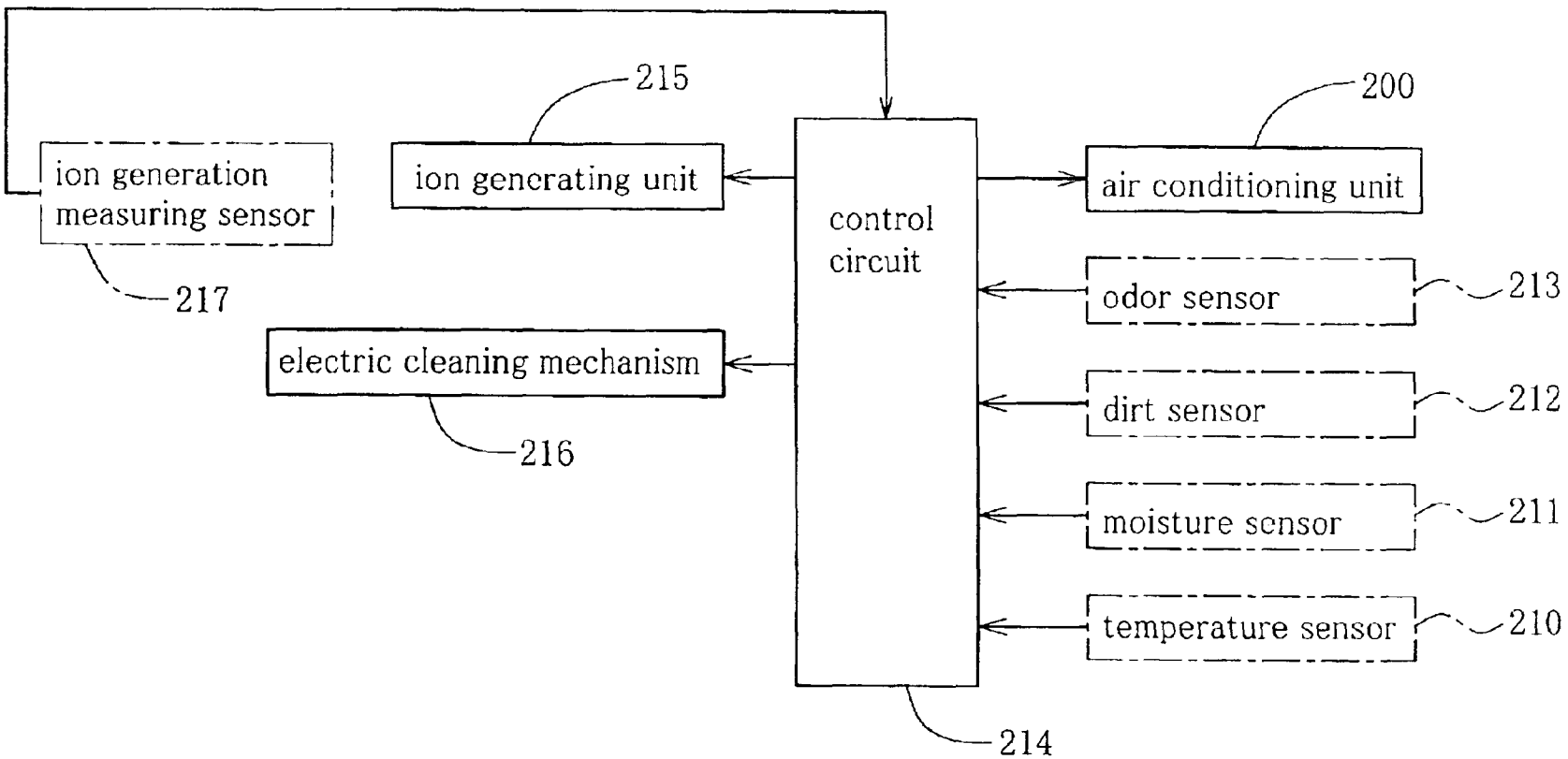
FIG. 22 is a block diagram of an exemplary electric constitution responsible for operational control of the electric cleaning mechanism based on detected results obtained from various environmental status information detecting portions.

FIG. 22 shows a block diagram schematically showing an electric constitution of the electric cleaning mechanism. A control circuit 214 which is mainly composed of a microprocessor is provided as the cleaning mechanism operation control portion, to which a temperature sensor 210, a moisture sensor 211, a dirt sensor 212 and an odor sensor 213, which are all well known, are connected as the environmental status information detection portion (also the connection of only a part of such sensors also allowable). The control circuit 214 is connected to an ion generation unit 215 (comprising the main circuit unit for ion generation 5 and the ion generating electrode 7) as a target of the control, an electric cleaning mechanism 216 having a similar constitution as described in the above and an air conditioning unit 200.

The control circuit 214 raises at least either of output power of electric heating (e.g., voltage for spark discharge) and heating time (sustainable time of spark discharge) for cleaning the ion generating electrode 7 as temperature detected by the temperature sensor 210 rises, or as humidity detected by the moisture sensor 211 rises. So that it is ensured that the cleaning of the ion generating electrode 7 can be completed in a necessary and sufficient level even under a hot or humid condition which tends to interfere easy removal of the dirt. It is to be noted that the output power of electric heating or heating time is increased in a continuous manner (i.e., non-stepwise manner) or in a stepwise manner while being bounded by a reference value of the temperature or humidity.

It is also allowable to compose the control circuit 214 so as to raise at least either of output power of electric heating (e.g., voltage for spark discharge) and heating time (sustainable time of spark discharge) for cleaning the ion generating electrode 7 as a level of odor or dirt detected by the odor sensor 213 or dirt sensor 212 rises. In the case such functions are incorporated into the air conditioning unit 200, the dirt sensor 212 can be composed of an optical sensor capable of detecting dirt on the filter F based on light reflectivity as shown in FIG. 21C.

It is still also allowable as shown in FIG. 22 to provide an ion generation measuring sensor 217 for measuring the amount of ions generated from the ion generating electrode 7, where the control circuit 214, also functions as an automatic cleaning mechanism control portion, can activate the electric cleaning mechanism 216 in order to clean the ion generating electrode 7 when the amount of ion generation comes short of a predetermined level. The ion generation measuring sensor 217 may be such that having a similar mechanism as the foregoing commercial ion counter. The dirt adhesion status on the ion generating electrode 7 is directly reflected in the amount of ion generation, so that detecting such amount, and cleaning the ion generating electrode 7 when the ion generation comes short of a predetermined level are advantageous in that always keeping the ion generation electrode 7 in a clean state, and in that ensuring a stable ion generation status.

Figure 15:
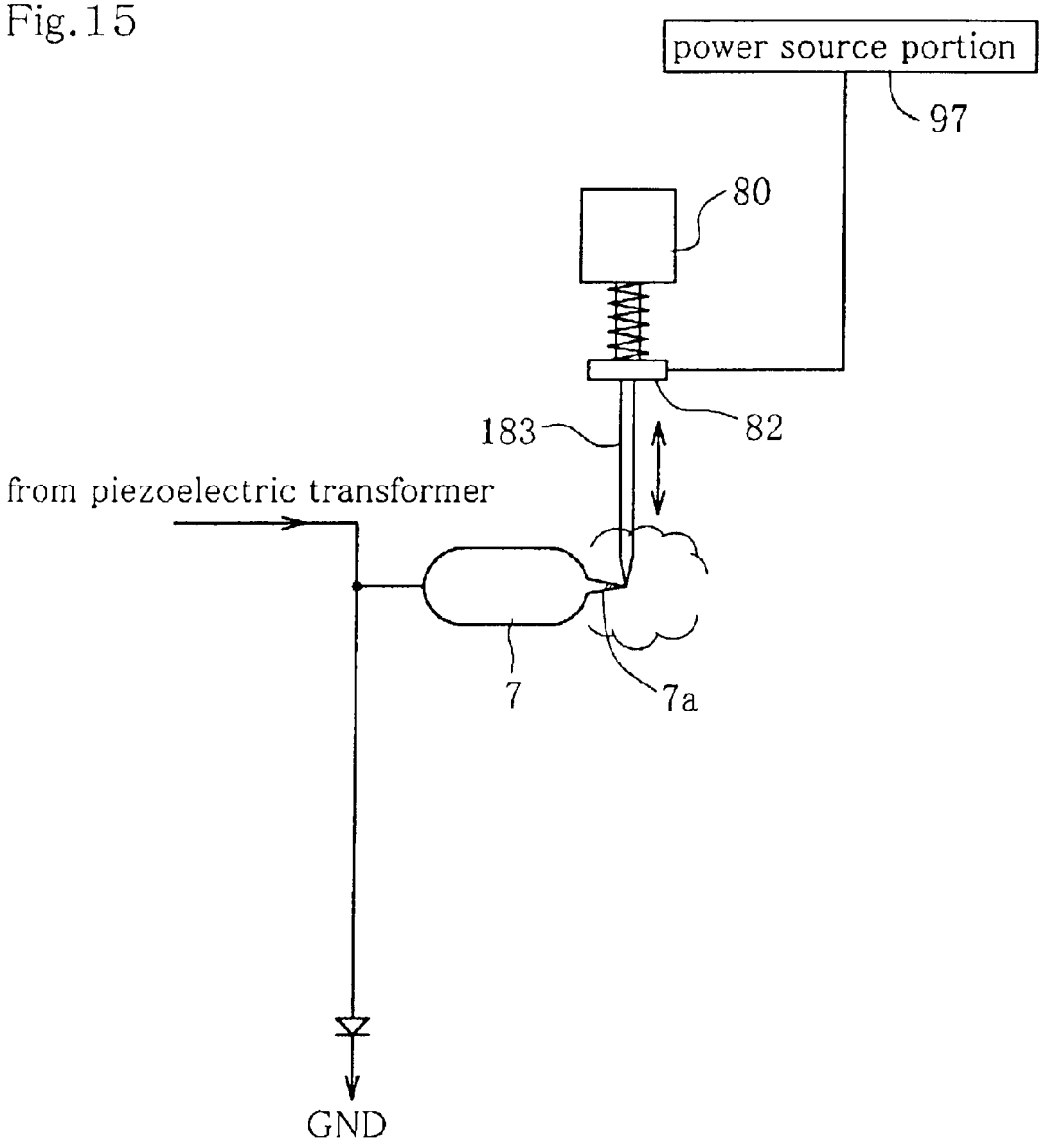
FIG. 15 is a schematic drawing showing an exemplary electric cleaning mechanism based on a current-fed heating system.

It is also allowable as shown in FIG. 15 to compose the electric cleaning mechanism so as to include a resistance heating mechanism for heating the ion generating electrode 7 through resistance heating to thereby burn out attachment adhered thereon. In the example shown in FIG. 15, the resistance heating mechanism comprises a current-fed member 183 movable between a contact position allowing it to contact with the ion generating electrode 7 and a distant position apart from such ion generating electrode 7, and a power source portion 97 for current-fed heating for feeding electric current via such current-fed member 183 to the ion generating electrode 7 for resistance heating while being contacted with such ion generating electrode 7. More specifically, the current-fed member 183 having a rod shape is operated by the solenoid 80 so as to approach to or depart from the end portion 7*a* of the ion generating electrode 7. A binding member 82 is attached to the basal end of the current-fed member 183 as being integrated therewith, to which the power source portion 97 for current-fed heating is connected. During the heating by current feeding, the current-fed member 183 is brought into contact with the ion generating electrode 7 so as to directly supply electric current thereto, to thereby selectively allow the end portion 7*a* having a gradually reducing sectional area to heat and thus burn out the adhered dirt.

Figure 16:
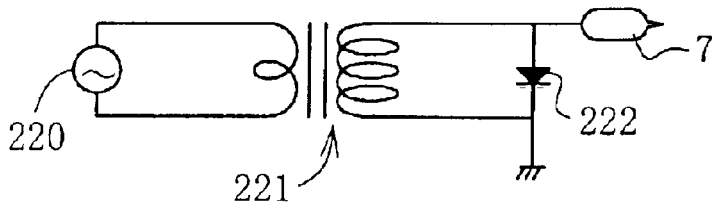
FIG. 16 is a diagram showing an exemplary constitution of a step-up portion using a wire-wound transformer.

A transformer available for the step-up portion 39 may be a wire-wound transformer 221 (where reference numeral 220 represents an AC power source, and 222 represents a diode for negative current application) as shown in FIG. 16. According to such constitution, it is no more necessary to use a radio-frequency AC specifically matches to the resonance frequency of the piezoelectric transformer, and instead, it may be allowable to use any commercial AC (e.g., 50 or 60 Hz, AC 100 V) to directly drive the main circuit unit for ion generation 5. The oscillating portion is of course omissible.

Figure 17:
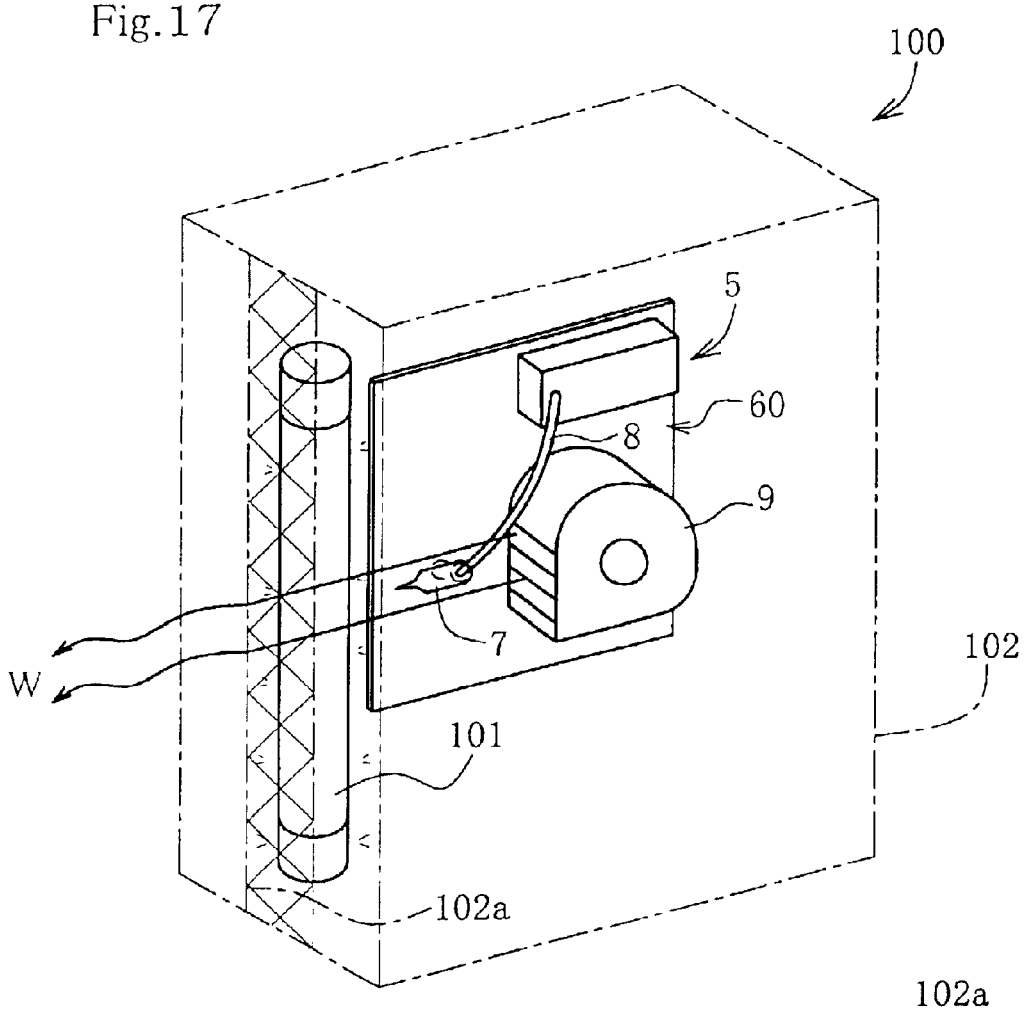
FIG. 17 is a schematic drawing of a modified example of the ion generating apparatus of the present invention.
Figure 17:
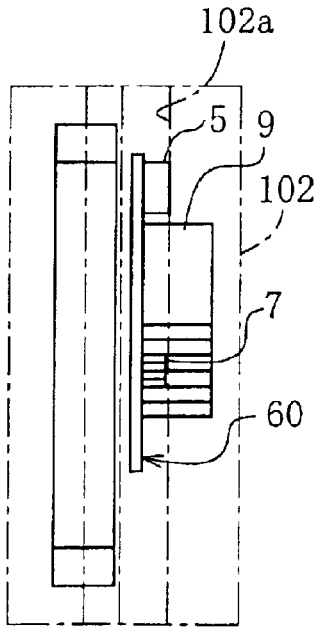
Figure 18:
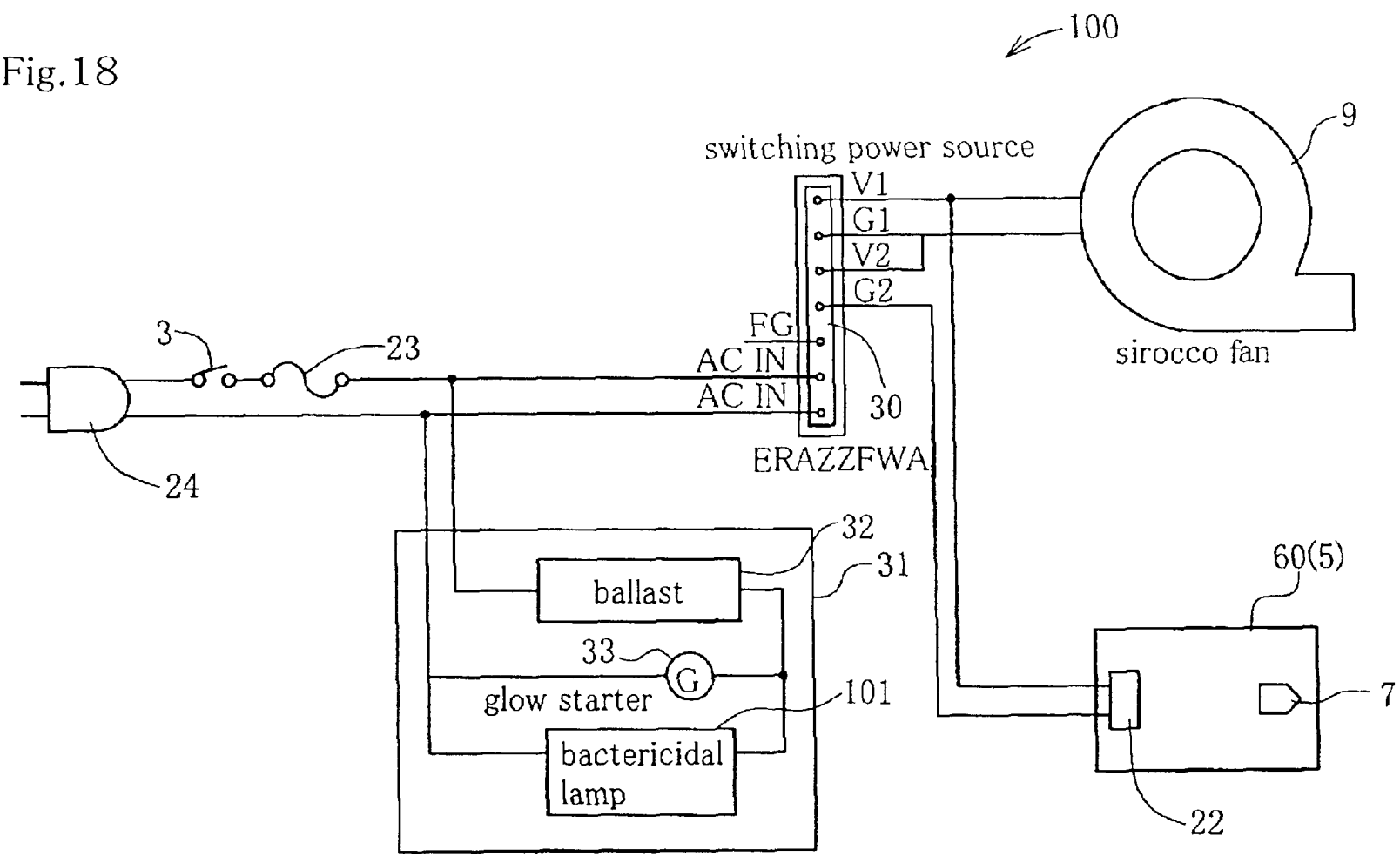
FIG. 18 is a circuit diagram showing an exemplary entire constitution of an electric system of the ion generation apparatus shown in FIG. 17.

FIG. 17 shows a modified example of the ion generating apparatus of the present invention. An ion generating apparatus 100 has, as being housed in a case 102, an ion generating unit 60, an air blower 9 and a known bactericidal lamp 101 as a UV generating source. In this embodiment, the ion generating unit 60 and air blower 9 are vertically arranged according to a positional relation almost similar to that shown in FIG. 2, so as to allow the generated negative ions to be emitted together with air flow from a slit-formed ion emitting hole 102*a* formed on the front side of the case 102. The bactericidal lamp 101 is located in a positional relation allowing the desirable emission of the air flow and generated ions from the ion emitting hole 102*a*, and for example at a site along the opening edge of such ion emitting hole 102*a*. FIG. 18 shows the exemplary circuit constitution. While the constitution is almost similar to that shown in FIG. 3, the input line from the external power source to be connected to the power source unit 30 is further connected with the bactericidal lamp 101 and a bactericidal lamp lighting unit 31 which comprises a known ballast 32 and a glow starter 33. This adds an effect of ultraviolet radiation from the bactericidal lamp 101 to the effect of generated negative ions, which successfully enhance the disinfectant and deodorant effects.

Figure 19A:
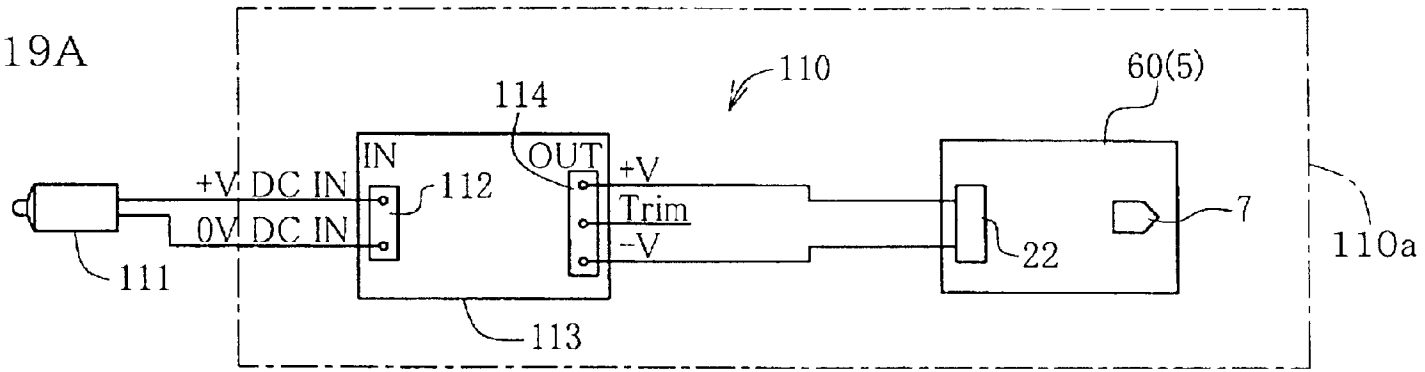
FIG. 19A is a schematic drawing of an exemplary circuit constitution of a carborne ion generating apparatus.
Figure 19B:
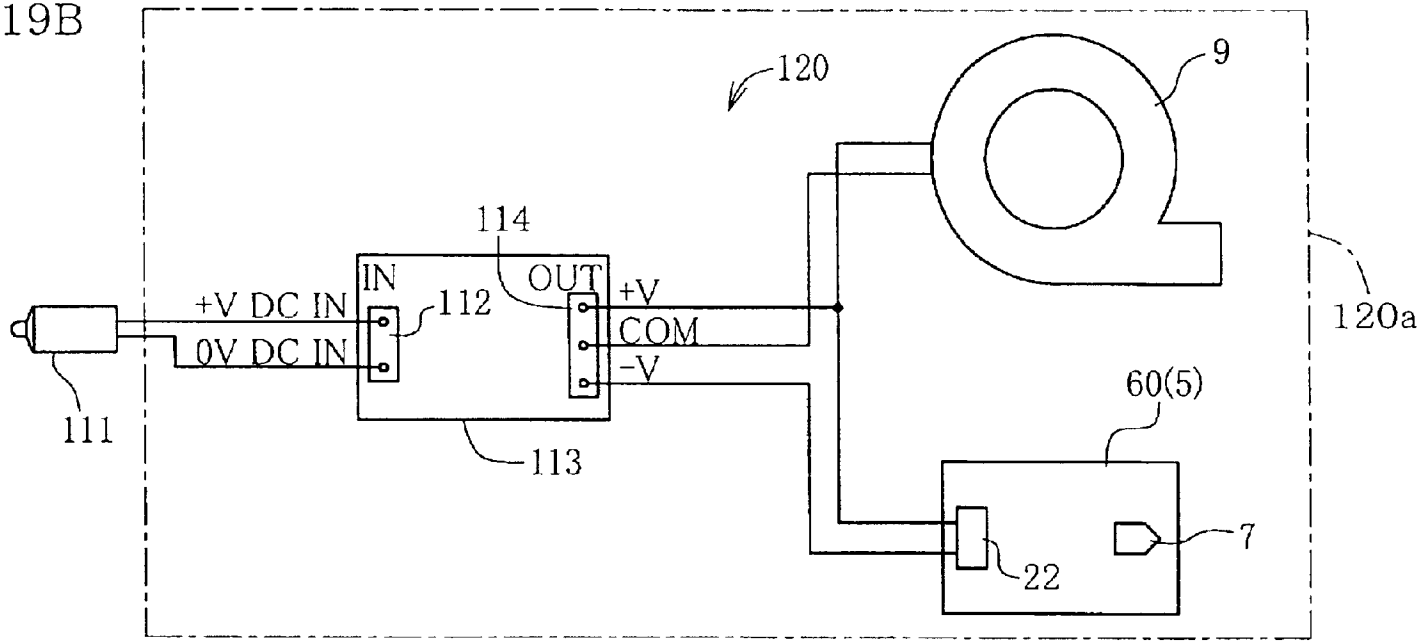
FIG. 19B is a schematic drawing of another exemplary circuit constitution of the same.

The air blower 9 used in the foregoing ion generating apparatuses 1, 100 may be omitted. While the foregoing power supply was such that using an external AC power source and DC conversion, it is also allowable to use a battery power source so as to add a portable nature, or it is still also allowable for a carborne purpose to use a sugar plug 111 which receives electric power from a cigarette lighter socket as in ion generating apparatuses 110, 120 (reference numerals 110*a* and 120*a* represent the cases) shown in FIGS. 19A and 19B. While the cigarette light socket generally operates as being powered by a carborne battery, which is a 12-V DC power source, power input received via the sugar plug 111 from the cigarette lighter socket in this embodiment is fed through a connector 112 to a stabilized DC power source circuit 113, and is then supplied through a connector 114 to the ion generating unit 60 or to the air blower 9. FIG. 19A shows an exemplary constitution omitting the air blower 9.

Figure 20:
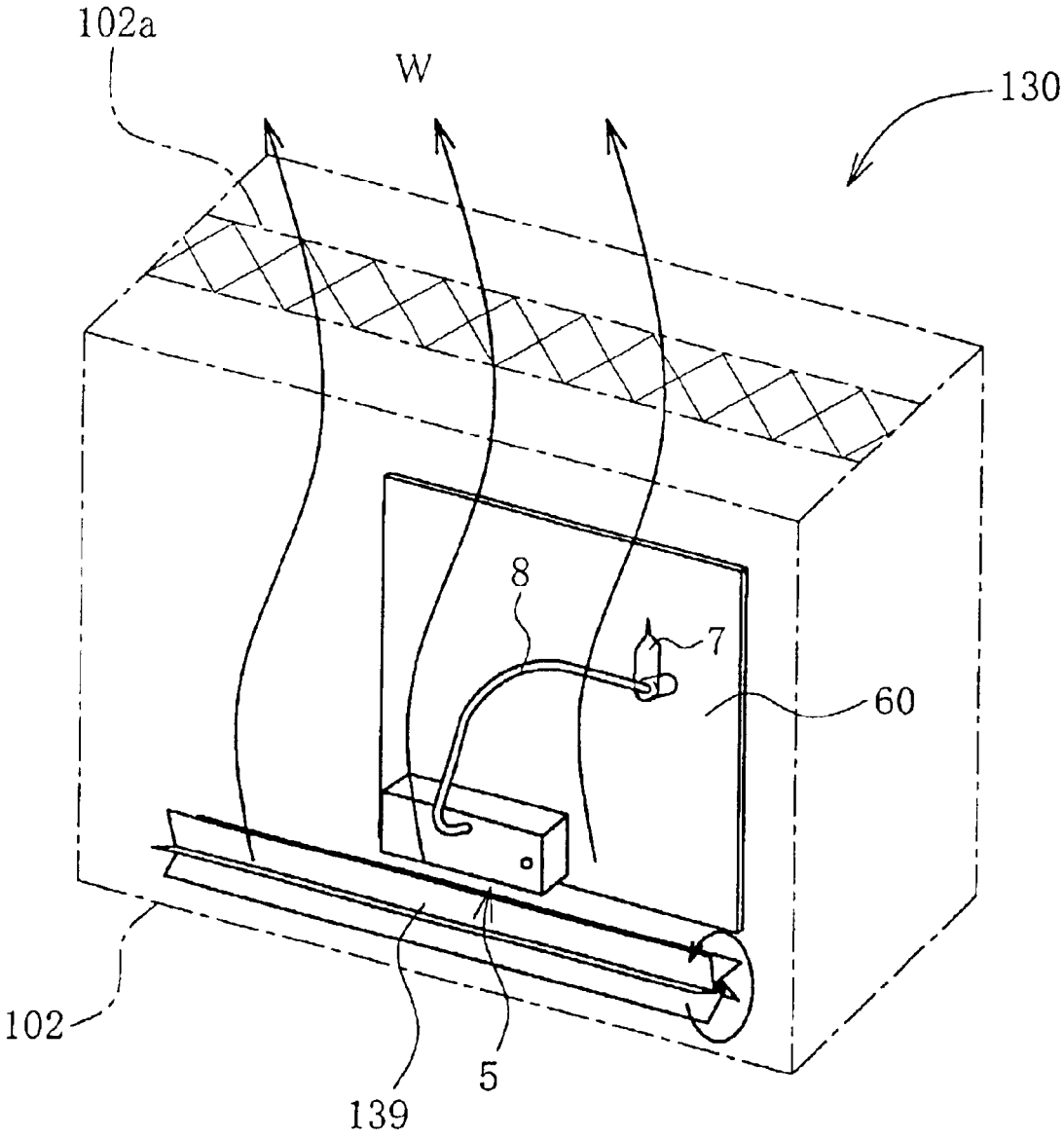
FIG. 20 is a schematic drawing of another modified example of the ion generating apparatus of the present invention.

An ion generating apparatus 130 shown in FIG. 20 has the ion generating unit 60 as being housed in the case 102 having the slit-formed ion emitting hole 102*a* on the top plane thereof. The ion generating electrode 7 in this example is attached so as to direct the end thereof towards the ion emitting hole 102*a*, which is normal to the direction shown in FIGS. 8A and 8B. Behind the ion generating unit 60 (lower side), a laterally elongated air blower 139 is located so that the axis of rotation thereof is aligned with the longitudinal direction of the slit-formed ion emitting hole 102*a*. This successfully generate air flow and resultantly ion flow which are uniform in the longitudinal direction of the ion emitting hole 102*a*.

What is claimed is:

1. An ion generating apparatus comprising:

an ion generating electrode for generating negative ions while being applied with a negative high voltage;

a high-voltage generating portion for ion generation for applying high voltage for generating ions to the ion generating electrode; and an electric cleaning mechanism for burning out attachment adhered on the ion generating electrode by electric heating.

2. The ion generating apparatus according to claim 1, wherein the ion generating electrode has a sharpened end, and the electric cleaning mechanism is such that burning out the attachment adhered on the end portion of such ion generating electrode.

3. The ion generating apparatus according to claim 1, wherein the electric cleaning mechanism comprises a spark-discharge counter electrode for spark discharge located as being opposed to the ion generating electrode, and a spark-discharge, high-voltage generating portion for applying high voltage for the spark discharge between the ion generating electrode and the spark-discharge counter electrode, so that the attachment adhered on the ion generating electrode can be burnt out by spark-by-discharge generated between such ion generating electrode and such spark-discharge counter electrode upon being applied with a high voltage.

4. The ion generating apparatus according to claim 3, wherein the ion generating electrode has a sharpened end, and the spark-discharge counter electrode is opposed to the end portion of such ion generating electrode.

5. The ion generating apparatus according to claim 4, wherein the spark-discharge counter electrode has a rod shape, and the end plane or lateral plane of such rod-shaped, spark-discharge counter electrode is opposed to the end portion of the ion generating electrode.

6. The ion generating apparatus according to claim 3, further comprising a moving mechanism for the spark-discharge counter electrode which relatively moves it closer to or more distant from the ion generating electrode at least between a furthest position allowing ion generation from the ion generate electrode and a closest position allowing generation of the spark-by-discharge between the spark-discharge counter electrode and ion generating electrode.

7. The ion generating apparatus according to claim 6, wherein the ion generating electrode has a sharpened end, and the moving mechanism for the spark-discharge counter electrode relatively moves such spark-discharge counter electrode closer to or more distant from the ion generating electrode in a direction angled from the direction viewing the end of the ion generating electrode at front ways.

8. The ion generating apparatus according to claim 6, wherein the ion generating electrode is fixed, and the moving mechanism for the spark-discharge counter electrode moves only such spark-discharge counter electrode.

9. The ion generating apparatus according to claim 3, wherein the high-voltage generating portion for ion generation also functions as the spark-discharge, high-voltage generating portion.

10. The ion generating apparatus according to claim 9, the wherein high-voltage generating portion for ion generation comprises a step-up transformer having the output side thereof connected to the ion-generating electrode.

11. The ion generating apparatus according to claim 1, wherein the electric cleaning mechanism includes a resistance heating mechanism for burning out the attachment adhered on the ion generating electrode by heating such ion generating electrode through resistance heating.

12. The ion generating apparatus according to claim 11, wherein the resistance heating mechanism comprises a current-fed member movable between a contact position allowing it to contact with the ion generating electrode and a distant position apart from such ion generating electrode, and a power source portion for current-fed heating for feeding electric current via such current-fed member to the ion generating electrode for resistance heating while being contacted with such ion generating electrode.

13. The ion generating apparatus according to claim 1, further comprising an automatic cleaning mechanism control portion capable of automatically activating, according to a predetermined timing, the electric cleaning mechanism so as to clean the ion generating electrode.

14. The ion generating apparatus according to claim 13, wherein the automatic cleaning mechanism control portion activates the electric cleaning mechanism upon power supply to such ion generating apparatus.

15. The ion generating apparatus according to claim 13, wherein the automatic cleaning mechanism control portion activates the electric cleaning mechanism when a predetermined time elapsed after the power supply to such generating apparatus.

16. The ion generating apparatus according to claim 13, wherein the automatic cleaning mechanism control portion activates the electric cleaning mechanism when an integrated operating time of such ion generating apparatus reaches a predetermined value.

17. The ion generating apparatus according to claim 16, further comprising an integrated operating time measurement means for measuring integrated operating time of such ion generating apparatus, and a reset means for resetting a measured value of the integrated operating time corresponding to the operation of the electric cleaning mechanism.

18. The ion generating apparatus according to claim 13, further comprising an environmental status information detecting portion responding to an environmental status in which such ion generating apparatus is placed, and a cleaning mechanism operation control portion for controlling the electric cleaning mechanism based on information output from such environmental status information detecting portion.

19. The ion generating apparatus according to claim 18, wherein the environmental status information detecting portion includes a temperature sensor, and the cleaning mechanism operation control portion increases at least either of output for electric heating or heating time in a step-wise or non-step-wise manner as temperature detected by such temperature sensor becomes higher.

20. The ion generating apparatus according to claim 18, wherein the environmental status information detecting portion includes a moisture sensor, and the cleaning mechanism operation control portion increases at least either of output for electric heating or heating time in a step-wise or non-step-wise manner as moisture detected by such moisture sensor becomes higher.

21. The ion generating apparatus according to claim 13, further comprising an ion generation measuring sensor for measuring the amount of ions generated from the ion generating electrode, and the automatic cleaning mechanism control portion activates the electric cleaning mechanism in order to clean the ion generating electrode when the amount of ion generation comes short of a predetermined level.

22. The ion generating apparatus according to claim 1, wherein the ion generating electrode is housed in an enclosure having an ion emitting hole, and further comprising an air blower for generating an air flow running beside the ion generating electrode towards such ion emitting hole.

23. The ion generating apparatus according to claim 22, further comprising an air conditioning mechanism for cooling or heating the air flow using a refrigerating cycle mechanism to thereby generate conditioned air, and the ion emitting hole also functions as a blow-off hole of such conditioned air.

24. The ion generating apparatus according to claim 22, wherein a plural number of the ion generating electrodes are housed in the enclosure.

25. The ion generating apparatus according to claim 1, wherein the high-voltage generating portion for ion generation comprises a piezoelectric transformer having on a piezoelectric ceramic device board an input terminal and an output terminal, whereby primary AC input voltage applied to the input terminal is raised by being mediated by mechanical vibration of such piezoelectric ceramic device board to the secondary AC output voltage to be output through the output terminal towards the ion generating electrode, and further comprises a polarity conversion means for converting the secondary AC output voltage so as to ensure negative predominance of the polarity of voltage applied to the ion generating electrode.

26. The ion generating apparatus according to claim 25, wherein the amount of generation of negative ions measured at a position 1 m away frontward from the end of the ion generating electrode is 100,000 ions/$cm^3$ or more, and an amount of generation of ozone is 0.1 ppm or less.

27. The ion generating apparatus according to claim 26, wherein the amount of generation of ozone is 0.01 ppm or more and 0.04 ppm or less.

28. The ion generating apparatus according to claim 25, wherein the claim wherein piezoelectric ceramic device board is composed of a perovskitic piezoelectric ceramic of lead zirconate titanate base, frequency of the primary AC input voltage is set within a range from 40 to 300 kHz, voltage level of the primary AC input voltage applied to such piezoelectric ceramic device board ranges from 15 to 40 V, and voltage level applied to the ion generating electrode ranges from 500 to 2,000 V.

29. The ion generating apparatus according to claim 25, further comprising a primary AC input waveform generation circuit having provided therein an oscillation circuit oscillating at a frequency corresponded to the primary AC input and a switching circuit allowing high-speed switching of a predetermined level of DC input at the frequency of such oscillation upon receiving the waveform signal from the oscillation circuit, and still further comprising a feedback capacitance which is provided on a route for feeding the secondary AC output from the piezoelectric transformer back to such oscillation circuit.

30. The ion generating apparatus according to claim 29, wherein the piezoelectric transformer is assembled on a insulating board so as to keep a piezoelectric ceramic device board of such piezoelectric transformer and such insulating board in parallel, where the back surface of such insulating board is covered with a metal film electrode in an area corresponded to the piezoelectric ceramic device board, and such metal film electrode and the piezoelectric ceramic device board, together with the portion sandwiched between them, form a feedback capacitance.

* * * * *

UNITED STATES PATENT AND TRADEMARK OFFICE

CERTIFICATE OF CORRECTION

PATENT NO. : 6,791,814 B2
DATED : September 14, 2004
INVENTOR(S) : Yoshiichi Adachi and Yuji Kato It is certified that error appears in the above-identified patent and that said Letters Patent is hereby corrected as shown below:

Column 19,
Line 55, delete the word “the” after “claim 9,”
Line 56, insert the word -- the -- after “wherein”

Signed and Sealed this

Tenth Day of May, 2005

JON W. DUDAS
*Director of the United States Patent and Trademark Office*